US006431068B1

(12) United States Patent
Asai et al.

(10) Patent No.: US 6,431,068 B1
(45) Date of Patent: Aug. 13, 2002

(54) PLATE EXCHANGING APPARATUS IN ROTARY PRINTING PRESS

(75) Inventors: Takeshi Asai; Hirotaka Iida, both of Ibaragi (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/662,267

(22) Filed: Sep. 13, 2000

(30) Foreign Application Priority Data

Sep. 14, 1999 (JP) ..... 11-259770

(51) Int. Cl.[7] ..... B41F 27/06; B41L 47/14
(52) U.S. Cl. ..... 101/477; 101/415.1
(58) Field of Search ..... 101/477, 415.1, 101/378, 382.1, 383, 216, DIG. 36

(56) References Cited

U.S. PATENT DOCUMENTS 5,595,120 A * 1/1997 Métrope ..... 101/477
5,623,877 A * 4/1997 Muth ..... 101/486
5,758,579 A * 6/1998 Marmin et al. ..... 101/477
6,053,105 A * 4/2000 Rudzewitz ..... 101/477

FOREIGN PATENT DOCUMENTS

| | | |
|---|---|---|
| DE | 0 933 206 A1 | 8/1999 |
| DE | 0 933 208 A2 | 8/1999 |
| DE | 0 933 208 A3 | 3/2000 |
| JP | 62221542 | 9/1987 |
| JP | 11-077968 | 3/1999 |

* cited by examiner

*Primary Examiner*—Leslie J. Evanisko
(74) *Attorney, Agent, or Firm*—Blakely Sokoloff Taylor & Zafman

(57) ABSTRACT

A plate exchanging apparatus in a rotary printing press, which removes an old plate from a plate fixing unit of a plate cylinder and inserts a new plate includes a plate holder and an actuator. The plate holder holds the new plate. The actuator performs one of moving and swinging operations of the plate holder in directions to come close to and separate from the plate cylinder. The actuator selectively positions the plate holder to a first position where the new plate is held in the plate holder, a second position where the new plate held by the plate holder is retreated from an old plate removal path, and a third position where the new plate is inserted into the plate fixing unit of the plate cylinder.

11 Claims, 24 Drawing Sheets

PLATE EXCHANGING APPARATUS IN ROTARY PRINTING PRESS

BACKGROUND OF THE INVENTION

The present invention relates to a plate exchanging apparatus in a rotary printing press for removing an old plate from a plate fixing unit of a plate cylinder and inserting a new plate.

As an apparatus of this type, one is disclosed in Japanese Patent Laid-Open No. 11-77968. The disclosed apparatus has a cassette which is swingably supported by frames and has a new plate setting unit for setting a new plate and an old storage unit for storing an old plate, and an actuator for reciprocating the cassette between two positions, a plate mounting position and a retreat position. In this arrangement, when the cassette is moved to the plate mounting position by the actuator, the distal end of the cassette opposes the plate fixing unit of the plate cylinder. When the plate cylinder rotates almost one revolution from this state, an old plate whose leading and trailing edges are released from the plate fixing unit of the plate cylinder is stored in the old plate storage unit of the cassette. After the leading edge of a new plate set on the new plate setting unit is inserted into the plate fixing unit of the plate cylinder, the plate cylinder rotates almost one revolution, and the new plate is set on the plate cylinder.

In the conventional plate exchanging apparatus, the cassette is disposed between two adjacent printing units, and the cassette has the new plate setting unit for setting a new plate and the old plate storage unit for storing an old plate. For this reason, the cassette has a large outer size to narrow the work space between the printing units and degrade workability in maintenance and inspection. Since the cassette must be reciprocated between the plate mounting position and the retreat position, a large actuator is required. This not only increases the apparatus scale but also complicates its structure.

SUMMARY OF THE INVENTION

It is an object of the present invention to provide a plate exchanging apparatus in a rotary printing press in which workability is improved.

It is another object of the present invention to provide a compact, simple plate exchanging apparatus in a rotary printing press.

In order to achieve the above objects of the present invention, there is provided a plate exchanging apparatus in a rotary printing press, which removes an old plate from a plate fixing unit of a plate cylinder and inserts a new plate, comprising a plate holder for holding the new plate, and actuator means for performing one of moving and swinging operations of the plate holder in directions to come close to and separate from the plate cylinder, wherein the actuator means selectively positions the plate holder to a first position where the new plate is held in the plate holder, a second position where the new plate held by the plate holder is retreated from an old plate removal path, and a third position where the new plate is inserted into the plate fixing unit of the plate cylinder.

DESCRIPTION OF THE PREFERRED EMBODIMENTS

The present invention will be described in detail with reference to the accompanying drawings.

Figure 1:
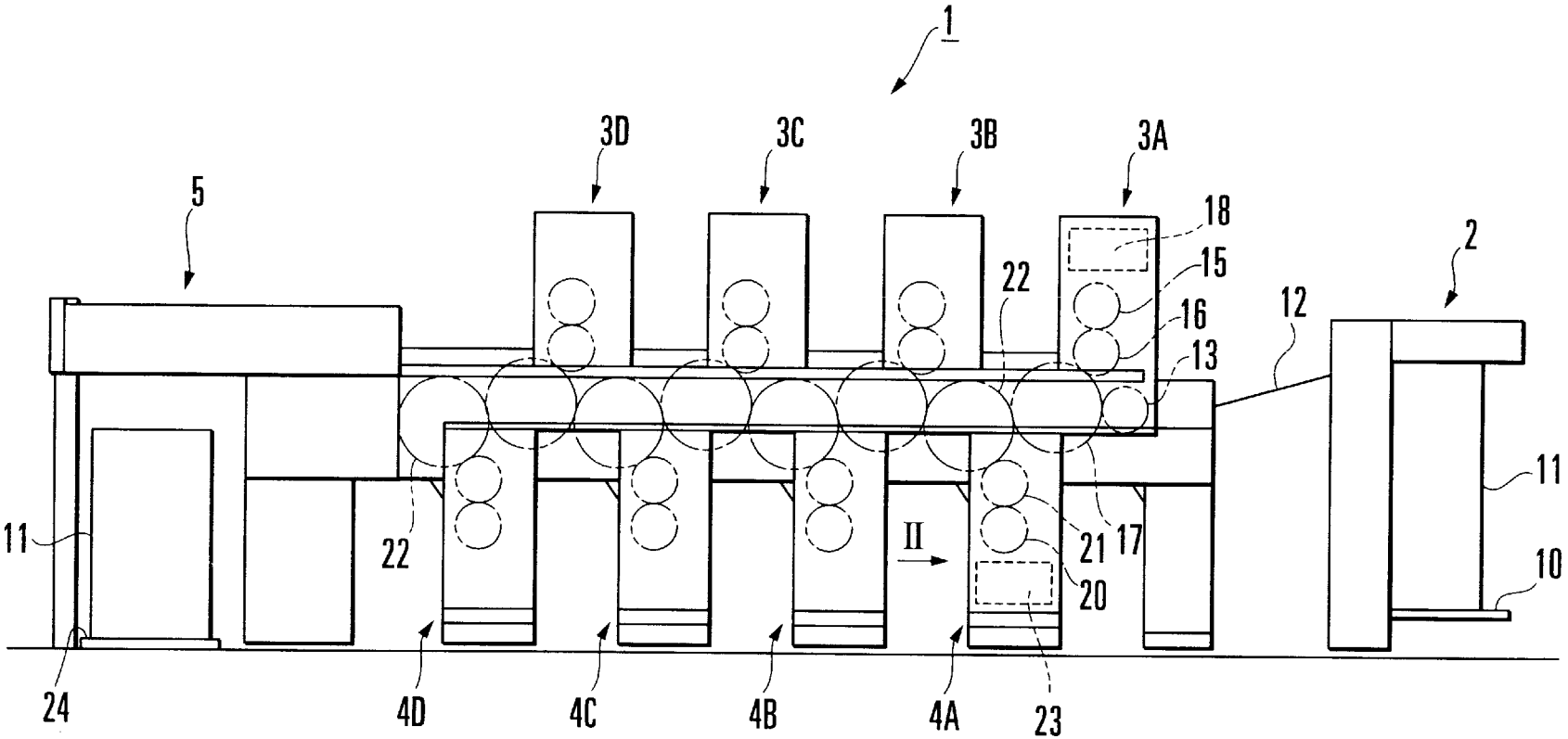
FIG. 1 is a view showing the schematic structure of a whole rotary printing press according to the first embodiment of the present invention.

FIG. 1 schematically shows the structure of a rotary printing press according to the first embodiment of the present invention. Referring to FIG. 1, a double-sided sheet-fed rotary printing press 1 is schematically comprised of a sheet feed unit 2, four printing units 3A to 3D for face side printing lined up on the upper side, four printing units 4A to 4D for reverse side printing lined up on the lower side, and a delivery unit 5.

The sheet feed unit 2 has a conventional widely known sucker unit (not shown) for feeding out sheets 11 stacked on a sheet pile plate 10 to a feeder board 12 one by one. Each sheet 11 fed out to the feeder board 12 is gripped by the grippers of a transfer cylinder 13 of the first-color printing unit 3A by a swing unit (not shown) provided at the distal end of the feeder board 12.

Each of the four printing units 3A to 3D for face side printing has a plate cylinder 15 on which a plate is set, a blanket cylinder 16 in contact with the plate cylinder 15, and an impression cylinder 17 in contact with the blanket cylinder 16 and having a diameter twice that of the blanket cylinder 16. An inker 18 for storing an inking device is provided above the plate cylinder 15. The sheet 11 gripped by the grippers of the transfer cylinder 13 is then transferred to the grippers of the impression cylinder 17 and gripped by them. While the sheet 11 is being conveyed between the blanket cylinder 16 and impression cylinder 17, first-color printing is performed on its face side.

Each of the four printing units 4A to 4D for reverse side printing has a plate cylinder 20 on which a plate is set, a blanket cylinder 21 in contact with the plate cylinder 20, and an impression cylinder 22 in contact with the blanket cylinder 21 and having a diameter twice that of the blanket cylinder 21. An inker 23 for storing an inking device consisting of a group of a large number of rollers (not shown) is provided below the plate cylinder 20.

The sheet 11 is transferred from the grippers of the impression cylinder 17 of the face side printing unit 3A to the grippers of the impression cylinder 22 of the reverse side printing unit 4A and gripped by them. While the sheet 11 is being conveyed between the impression cylinder 22 and blanket cylinder 21, first-color printing is performed on its reverse side. After that, second- to fourth-color printing operations are sequentially performed on the face and reverse sides of the sheet 11 by the face side printing units 3B to 3D and reverse side printing units 4B to 4C.

The sheet 11 gripped by the grippers of the impression cylinder 22 of the fourth-color reverse side printing unit 4D is transferred to a gripper unit provided to a gripper bar extending between the pair of right and left delivery chains of the delivery unit 5, and gripped by them. The sheet 11 gripped by the gripper unit is conveyed by the delivery chains and released from the gripper unit by a cam mechanism. Thus, the sheet 11 falls on a sheet pile plate 24 and is piled there.

Figure 3:
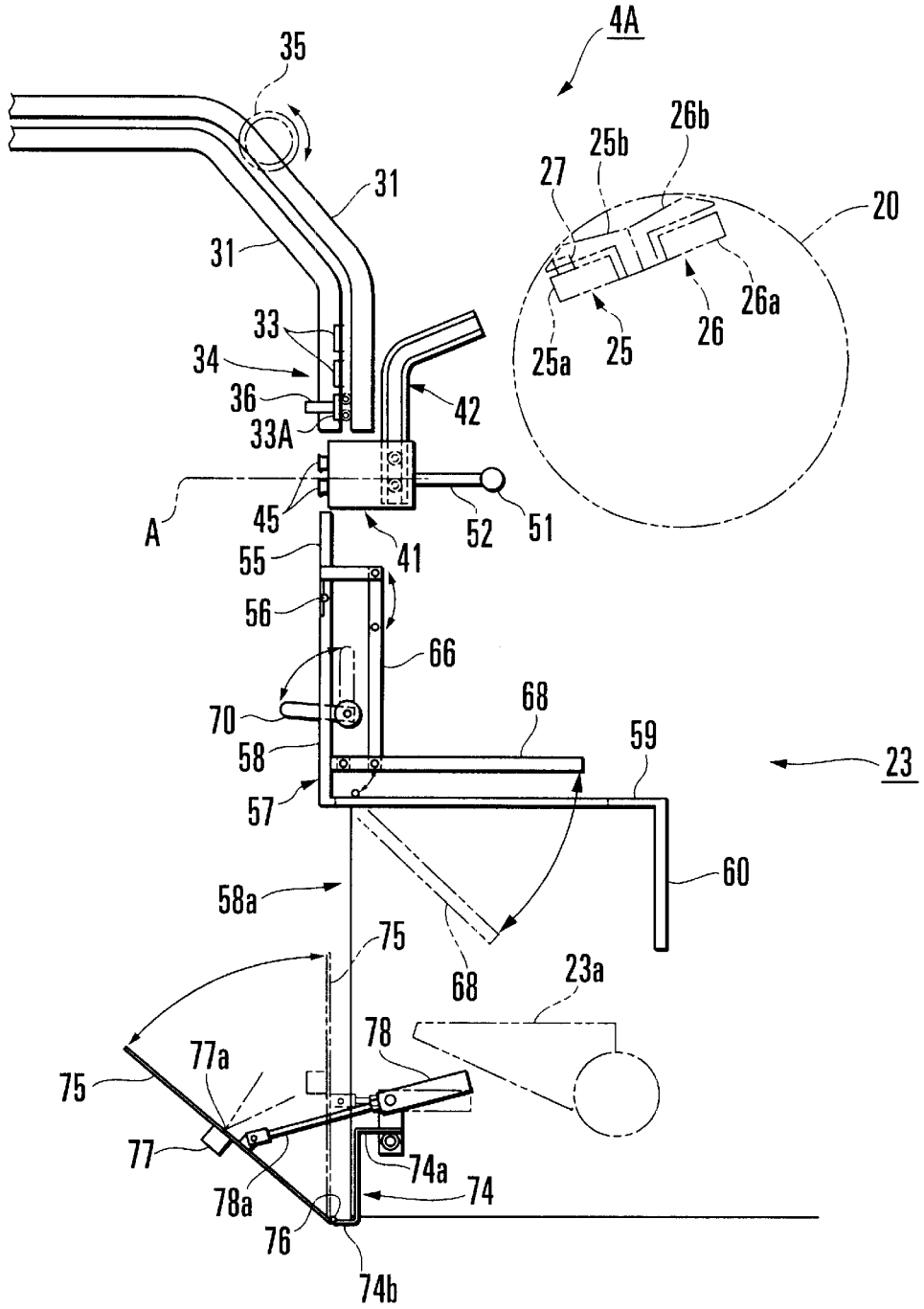
FIG. 3 is a view seen from the arrow III of FIG. 2.

As shown in FIG. 3, a leading edge plate clamp 25 and trailing edge plate clamp 26 are provided in a notch formed in the outer surface of the plate cylinder 20. The two clamps 25 and 26 have bottom clamping rails 25*a* and 26*a* and gripper boards 25*b* and 26*b*, respectively. A pair of reference pins 27 lined up in the axial direction of the plate cylinder 20 vertically stand on the upper surface of the bottom clamping rail 25*a* of the leading edge plate clamp 25. The reference pins 27 engage with a pair of notches 7 formed in the leading edge of a new plate P2 to position the new plate P2 in the circumferential and widthwise directions. The arrangement of the cylinders and the plate clamp units described above are not different from those of a conventional widely known double-sided sheet-fed rotary printing press.

A plate mounting unit in the sheet-fed rotary printing press, which is employed by each of the reverse side printing units 4A to 4D will be described with reference to FIGS. 2 to 21. Plate inserting apparatuses employed by the respective printing units 4A to 4D have completely the same structure, and accordingly only the plate mounting unit employed by the printing unit 4A will be described.

Figure 2:
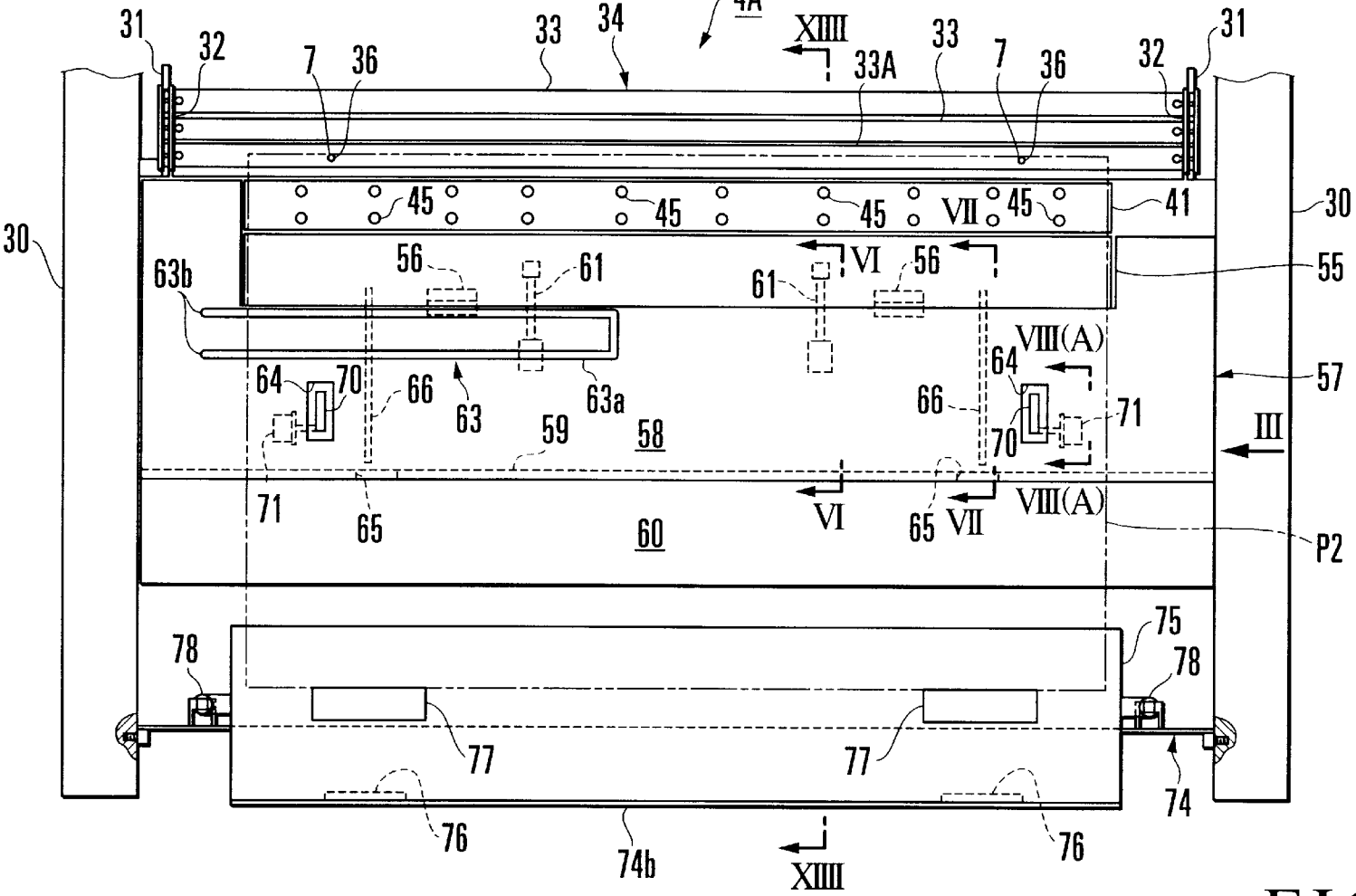
FIG. 2 is a view seen from the arrow II of FIG. 1.

Referring to FIG. 2, the printing unit 4A has a pair of opposing frames 30, and a pair of chain guides 31 are fixed to the inner sides of the upper portions of the frames 30. A pair of chains 32 are supported by the chain guides 31 to be vertically slidable, and a plurality of elongated blocking plates 33 horizontally extend between the chains 32.

As shown in FIG. 3, a safety cover 34 formed by the plurality of blocking plates 33 is driven by sprockets 35 to open/close the front surface of the plate cylinder 20. The teeth of each sprocket 35 oppose the inside of the corresponding blocking plate 33. More specifically, the teeth of the sprockets 35 mesh with the chains 32, and the sprockets 35 are rotated clockwise or counterclockwise in FIG. 3 by a safety cover drive motor 87 (FIG. 9) which drives in the forward/reverse directions. When the sprockets 35 rotate clockwise, the safety cover 34 moves upward to open the front surface of the plate cylinder 20. When the sprockets 35 rotate counterclockwise, the safety cover 34 moves downward to close the front surface of the plate cylinder 20. A pair of reference pins 36 stand vertically from a lowermost blocking plate 33A of the plurality of blocking plates 33. The reference pins temporarily position the plate before holding.

Figure 4:
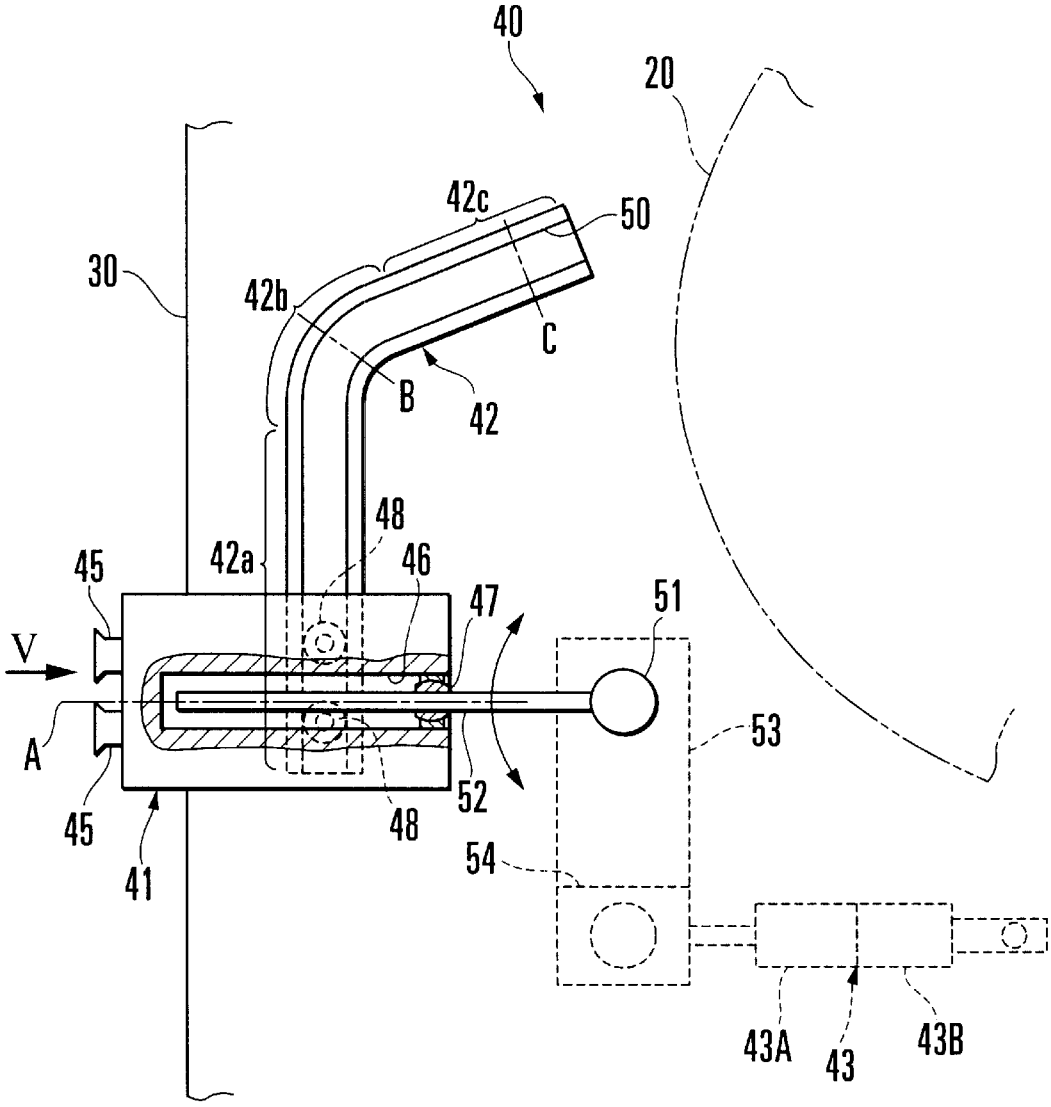
FIG. 4 is an enlarged side view of the driver of the plate holder shown in FIG. 3.
Figure 5:
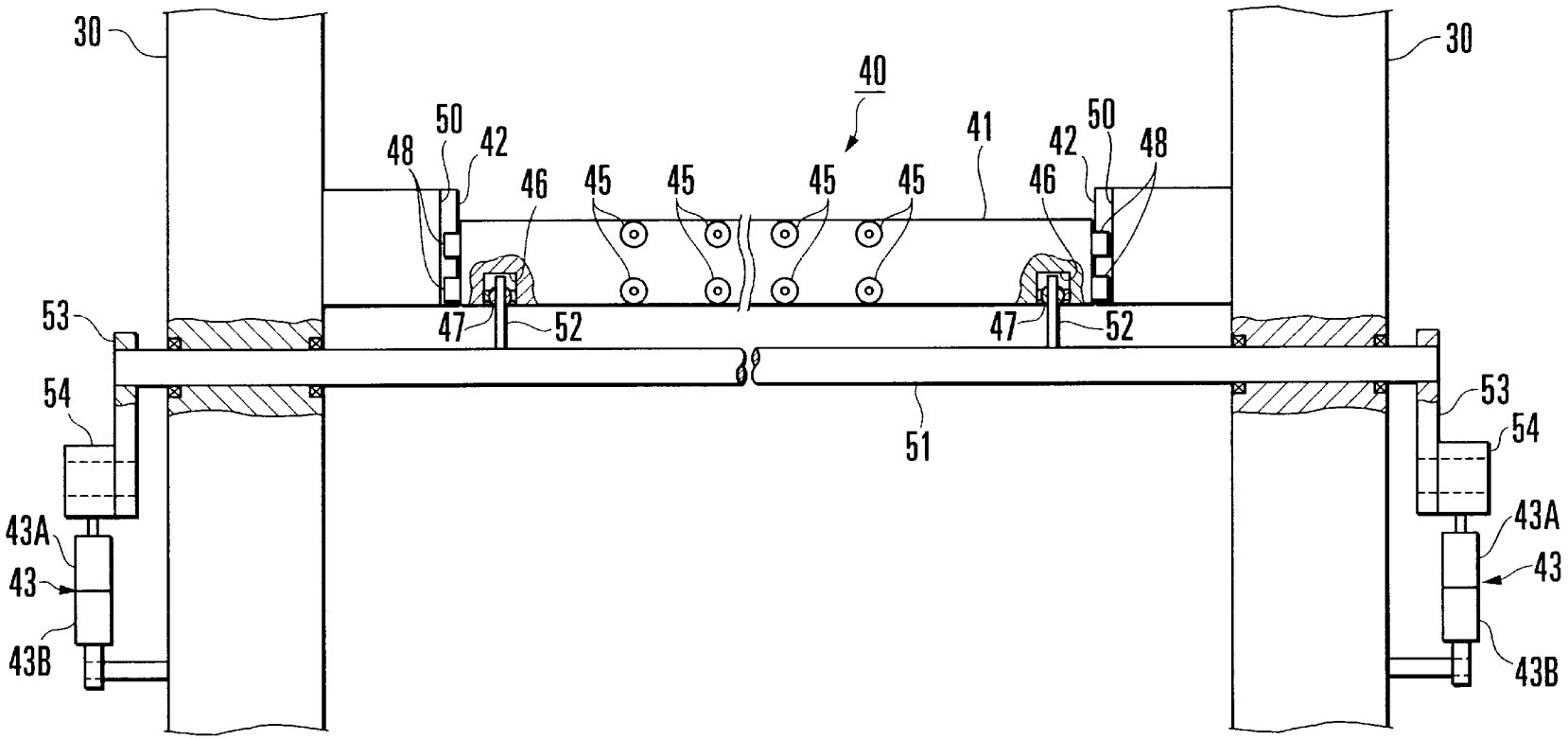
FIG. 5 is a view seen from the arrow V of FIG. 4.

A plate inserting apparatus 40 will be described with reference to FIGS. 2 to 5. Referring to FIG. 5, the plate inserting apparatus 40 is comprised of a plate holder 41 for holding the new plate P2 by drawing by suction its leading edge, a pair of guide rails 42 serving as posture changing means to guide the plate holder 41, and actuators 43 for moving the plate holder 41.

Each actuator 43 is constituted by a first actuator 43A for the plate holder and second actuator 43B for the plate holder. The rear portions of the two actuators 43A and 43B are connected and fixed to each other. The driving states, i.e., the operative state (ON) and the inoperative state (OFF), of the actuators 43A and 43B are combined to selectively position the plate holder 41 at three points A, B, and C described later.

The plate holder 41 has an elongated rectangular parallelepiped shape, and has two rows of a large number of suction pads 45 on its front surface. Suction air from a suction pump 86 (FIG. 9) is supplied to the suction pads 45 as a negative pressure. As shown in FIG. 4, a pair of blind hole-type fitting insertion holes 46 are formed in the rear surface of the plate holder 41. Spherical sliding bearings 47 are fixed to the openings of the fitting insertion holes 46. As shown in FIG. 5, two pairs of rollers 48 are rotatably supported at the right and left ends of the plate holder 41.

The pair of guide rails 42 respectively have a pair of guide grooves 50 with a U-shaped section. As shown in FIG. 5, the guide rails 42 are fixed to the inner sides of the right and left frames 30 such that the guide grooves 50 face each other. As shown in FIG. 4, each guide rail 42 is comprised of a lower straight portion 42*a* extending substantially vertically, a curved portion 42*b* with one end connected to the straight portion 42*a*, and an upper straight portion 42*c* connected to the other end of the curved portion 42*b* and inclined obliquely upward toward the plate cylinder 20.

Figure 16B:
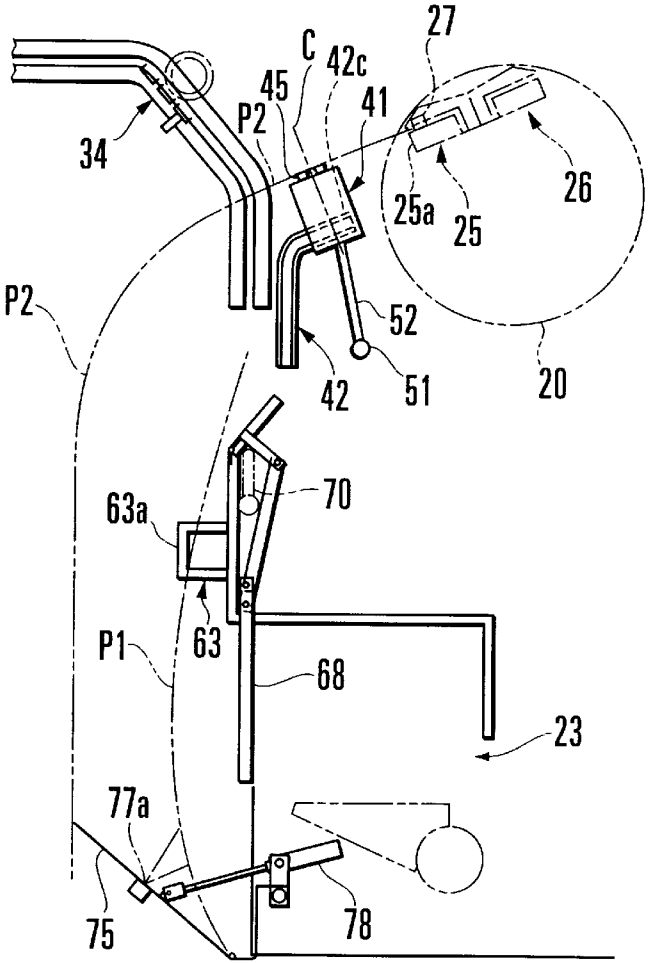
FIGS. 16A and 16B are sectional views taken along the line XIIII—XIIII of FIG. 2 to show states in full-automatic plate exchanging operation wherein an old plate is removed and a new plate is inserted in the plate fixing unit of a plate cylinder, respectively.

As shown in FIG. 16B, the inclination of the straight portion 42*c* is set such that it is substantially the same as that of the upper surface of the bottom clamping rail 25*a* of the leading edge plate clamp 25 which is positioned at a predetermined position when inserting the new plate. When the rollers 48 of the plate holder 41 are engaged in the guide grooves 50 of the guide rails 42, the plate holder 41 is movably supported to be guided by the guide grooves 50.

Referring to FIG. 5, a pair of round rod-shaped driving levers 52 stand between the central portion and the ends of a driving shaft 51 rotatably supported between the frames 30. The distal ends of the driving levers 52 are slidably and inclinably coupled to the spherical sliding bearings 47 of the plate holder 41. That is, the plate holder 41 is swingably supported by the driving levers 52 to be movable in the longitudinal direction of the levers. The two ends of the driving shaft 51 project outwardly from the frames 30. One end of each of a pair of intermediate levers 53 is fixed to the corresponding projecting end of the driving shaft 51. The other end of each intermediate lever 53 is fixed with a rotor 54, and the rotor 54 is fixed to the rod of the corresponding first actuator 43A. The distal ends of the rods of the second actuators 43B are fixed to the frames 30.

Referring to FIG. 4, when the rods of the two actuators 43A and 43B are at the retreat position, the plate holder 41 is positioned at the point A of the straight portion 42*a* of each guide rail 42. At the point A, the suction surfaces of the suction pads 45 are substantially vertical and substantially leveled with the front surface of the blocking plate 33A so that the new plate P2 can be set on the plate holder 41. The posture of the plate holder 41 in this state is defined as the first posture at which the new plate P2 is to be set on the plate holder 41, and the point A is defined as the first position. When the plate holder 41 is in the first posture, the new plate P2, the leading edge of which is drawn by suction with the suction pads 45, also becomes vertical. The plate holder 41 positioned at the first position is located immediately under the lowermost blocking plate 33A of the closed safety cover 34, as shown in FIG. 3.

Figure 16A:
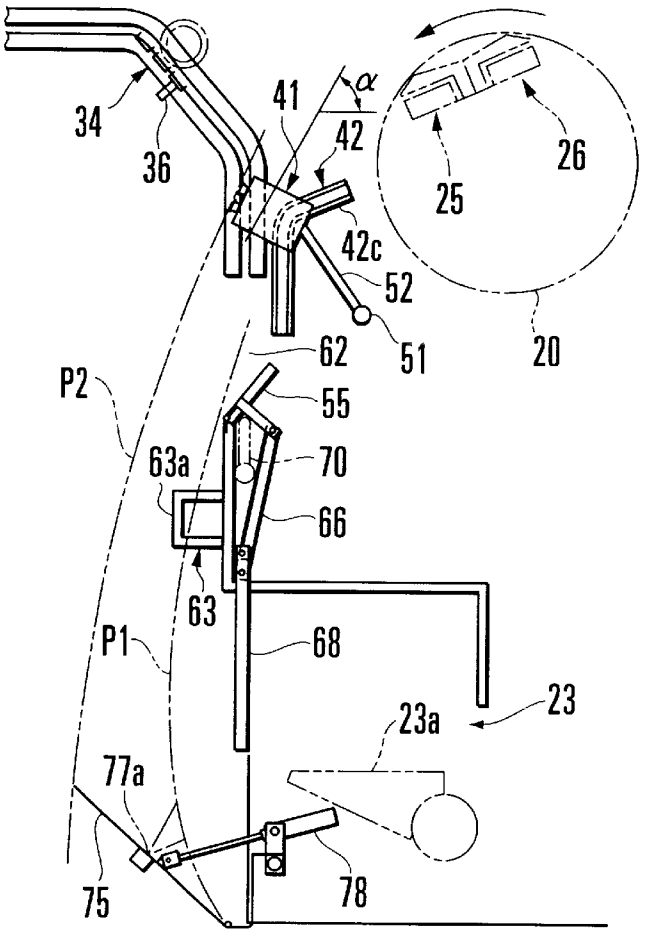

When the rod of each first actuator 43A is moved forward, the driving shaft 51 pivots clockwise in FIG. 4 through the corresponding rotor 54 and intermediate lever 53, and the plate holder 41 is positioned at the point B of the curved portion 42*b* of each guide rail 42. At the point B, the suction surfaces of the suction pads 45 of the plate holder 41 are inclined from the horizontal plane by an angle α, as shown in FIG. 16A, and the leading edge of the new plate P2 drawn by suction with the suction pads 45 is also inclined by the angle α. In this state, the leading edge of the new plate P2 to be drawn by suction with the suction pads 45 is retreated from an old plate removal port 62 to open the front side of the old plate removal port 62. An old plate P1 can accordingly be removed from the old plate removal port 62. The posture of the plate holder 41 at this time is defined as the second posture that enables removal of the old plate P1, and the point B is defined as the second position.

When the rod of each second actuator 43B is also moved forward, the driving shaft 51 pivots further clockwise in FIG. 4, and the plate holder 41 is positioned at the point C of the straight portion 42*c* of each guide rail 42. When the plate holder 41 is positioned at the point C, the upper surface of the bottom clamping rail 25*a* of the leading edge plate clamp 25 of the plate cylinder 20 is located on the extension of the suction surfaces of the suction pads 45, as shown in FIG. 16B. The posture of the plate holder 41 at this time is defined as the third posture that enables insertion of the new plate P2 between the bottom clamping rail 25*a* and gripper board 25*b*, and the point C is defined as the third position.

Referring to FIG. 4, the plate holder 41 is slidably supported by each driving lever 52. While the plate holder 41 moves along the straight portion 42*a* and straight portion 42*c* of each guide rail 42, when each driving lever 52 pivots, the plate holder 41 moves in the radial direction of this pivot movement as well. Thus, the pivot movements of the driving shaft 51 and driving lever 52 are converted into the linear movement of the plate holder 41 along the straight portions 42*c* and 42*a*.

In this manner, the plate holder 41 can be moved along the straight portions 42*a* and 42*c* of the guide rails 42 without using link mechanisms or cam mechanisms having a complicated structure, and the pivot movements of the driving shaft 51 and driving levers 52 are converted into the linear movement of the plate holder 41. The number of components is therefore reduced, and the structure is simplified.

A stationary cover and a plate removal cover will be described with reference to FIGS. 2, 3, 6A, 6B, 7A, and 7B. Referring to FIG. 3, a plate removal cover 55 is arranged immediately under the plate holder 41 positioned at the first point A. As shown in FIG. 2, the plate removal cover 55 is fixed to a stationary cover 57 at its lower end through a pair of hinges 56, and can fall to the inside of the printing press about the hinges 56 as the pivot center, as shown in FIG. 6B. In the normal state, the plate removal cover 55 is supported vertically.

As shown in FIG. 3, the stationary cover 57 is comprised of a front plate 58, horizontal plate 59, and rear plate 60, and has a crank-shaped section. The two ends of the stationary cover 57 are attached to the inner sides of the frames 30. An ink fountain 23*a* of the inking device stored in the inker 23 is provided below the horizontal plate 59. To supply ink to the ink fountain 23*a*, an opening 58*a* is formed below the front plate 58 of the stationary cover 57.

Figure 6A:
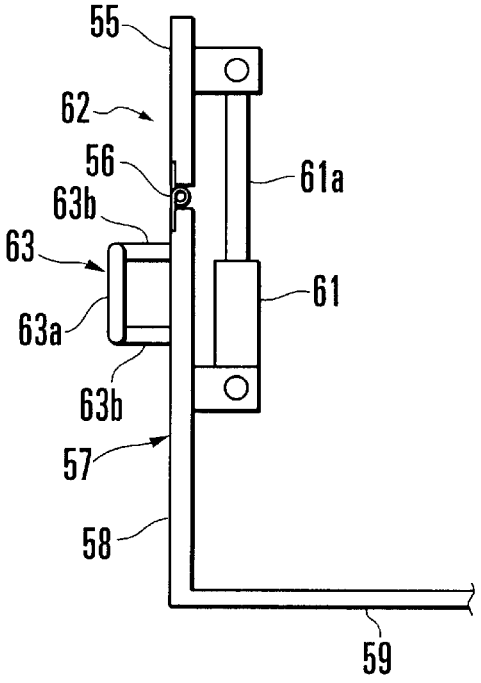
FIGS. 6A and 6B are sectional views taken along the line VI—VI of FIG. 2.
Figure 6B:
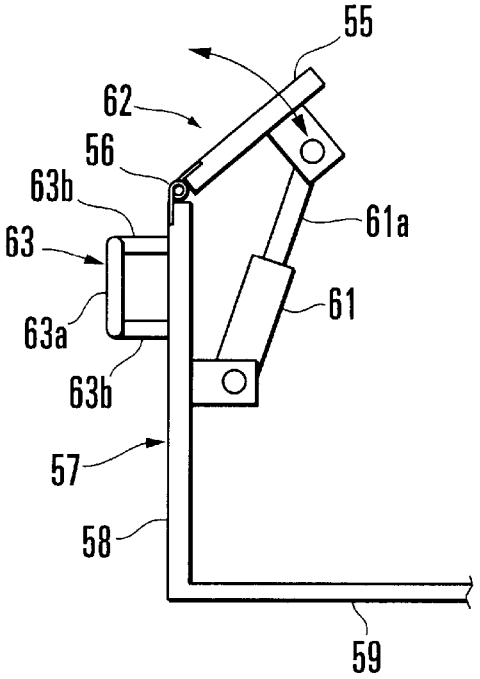

As shown in FIG. 6A, the lower ends of a pair of cover opening/closing actuators 61 are pivotally mounted on the rear surface of the front plate 58 of the stationary cover 57, and the distal ends of rods 61*a* of the cover opening/closing actuators 61 are pivotally mounted on the rear surface of the plate removal cover 55. When the rods 61*a* move forward, the plate removal cover 55 pivots counterclockwise about the hinges 56 as the pivot center to close the front surface of the printing unit 4A. When the rods 61*a* move backward, the plate removal cover 55 pivots clockwise about the hinges 56 as the pivot center, as shown in FIG. 6B. The front surface of the printing unit 4A is thus opened to form the old plate removal port 62.

Figure 7B:
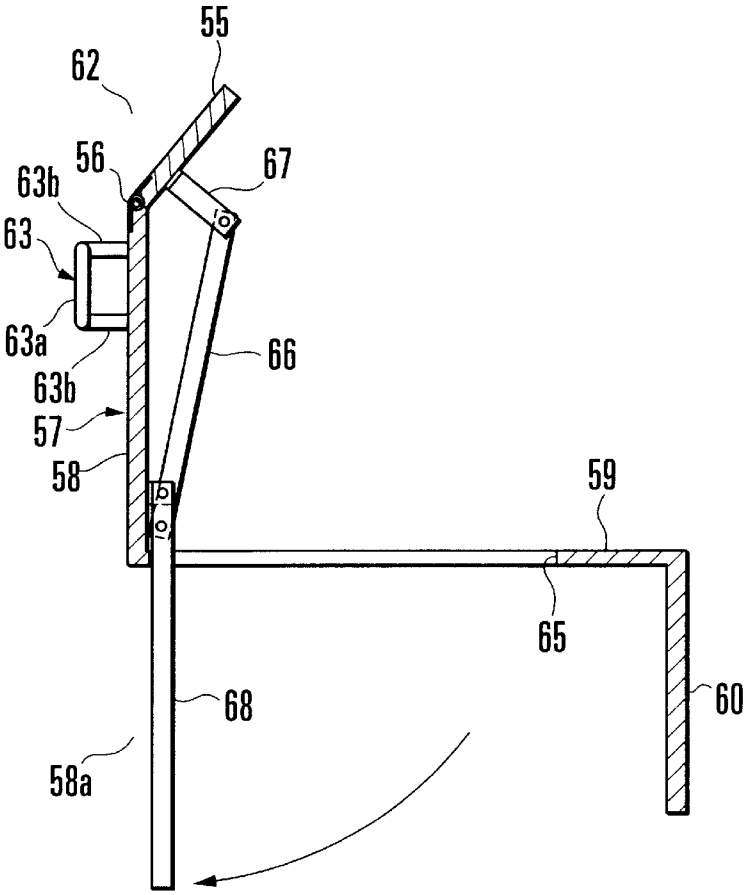
FIGS. 7A and 7B are sectional views taken along the line VII—VII of FIG. 2.
Figure 7A:
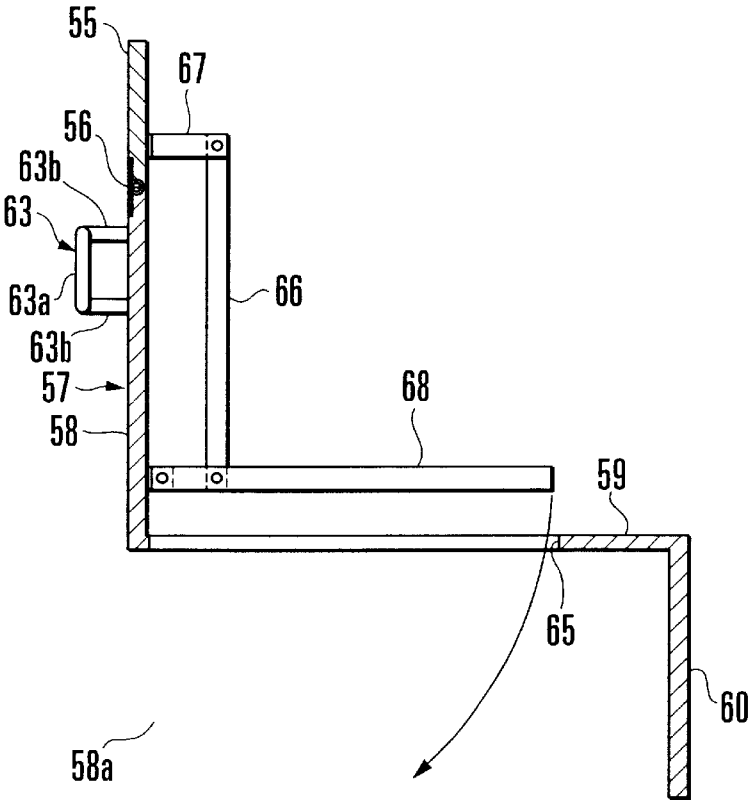

Referring to FIGS. 2 and 6A, a guide member 63 is comprised of a guide 63*a* formed by bending a rod into a U shape, and a pair of legs 63*b* formed by bending the two ends of the guide 63*a* at the right angle to support it in the cantilevered manner. Of the guide member 63, the legs 63*b* stand vertically at one end of the upper portion of the stationary cover 57, and the guide 63*a* extends horizontally parallel to the stationary cover 57 at a predetermined distance from it toward the central portion of the stationary cover 57. Thus, the old plate P1 held by a plate catch member (to be described later) is removed from the open end of the guide 63*a*. Referring to FIG. 2, a pair of rectangular windows 64 are formed in the two ends of the front plate 58 of the stationary cover 57. Referring to FIGS. 2, 7A, and 7B, a pair of elongated rectangular fitting insertion holes 65 are formed in the two ends of the horizontal plate 59 of the stationary cover 57.

Referring to FIGS. 2 and 7A, link members (link mechanisms) 66 respectively have upper ends pivotally mounted on levers 67 fixed to the rear surface of the plate removal cover 55, and lower ends pivotally mounted on flat plate-like plate approach regulating members 68. The plate approach regulating members 68 have proximal ends pivotally supported by the rear surface of the front plate 58 of the stationary cover 57. In the state of FIG. 7A wherein the plate removal cover 55 closes the old plate removal port 62, the plate approach regulating members 68 are horizontally supported so that their swing end sides are parallel to the fitting insertion holes 65. From this state, when the plate removal cover 55 pivots clockwise in FIG. 7B about the hinges 56 as the pivot center through a predetermined angle smaller than 90°, the plate approach regulating members 68 pivot clockwise through 90° through the link members 66 about their proximal ends as the pivot center, so that they pass through the fitting insertion holes 65 to close the upper portion of the opening 58*a*.

Figure 8A:
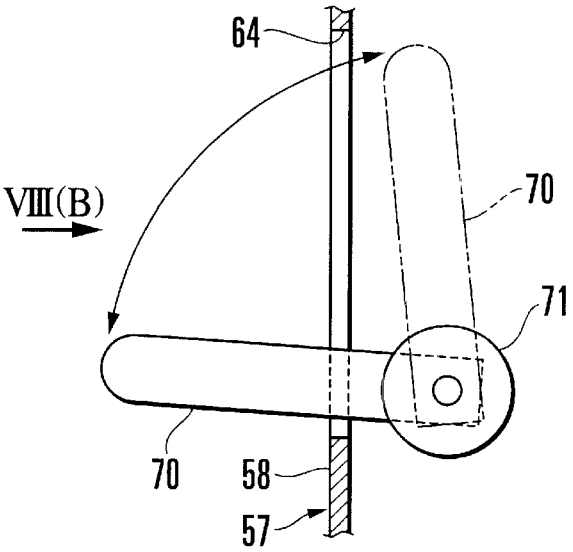
FIG. 8A is a sectional view taken along the line VIIIA—VIIIA of FIG. 2.
Figure 8B:
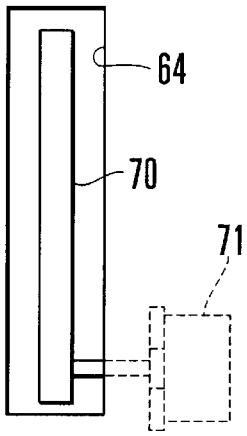
FIG. 8B is a view seen from the arrow VIIIB of FIG. 8A.

Referring to FIGS. 2, 8A, and 8B, plate pushout members 70 oppose the rear sides of the windows 64. The lower ends of the plate pushout members 70 are fixed to the pivot shafts of plate pushout actuators 71 fixed to the front plate 58 of the stationary cover 57. When the pivot shafts of the plate pushout actuators 71 pivot counterclockwise in FIG. 8A, the plate pushout members 70 also pivot counterclockwise to project to the outside of the front plate 58 through the windows 64.

A plate catch structure will be described with reference to FIGS. 2, 3 and 14. Referring to FIGS. 2 and 3, a bracket 74 with a crank shape when seen from the side surface horizontally extends between the lower ends of the frames 30, and has an upper surface 74*a* and lower surface 74*b*. A flat plate-like plate catch 75 has an elongated rectangular shape when seen from the front surface, and has a lower end connected to the lower surface 74*b* of the bracket 74 through hinges 76. The plate catch 75 is supported to be pivotal about the hinges 76 as the pivot center to open/close the lower portion of the opening 58*a*.

A pair of support members 77 are provided to the two ends of the front surface of the plate catch 75. Refection type photosensors 77*a* directed toward the inside of the plate catch 75 are attached to the rear portions or near the rear portions of the support members 77. A pair of plate catch driving actuators 78 are pivotally mounted on the upper surface 74*a* of the bracket 74, and the distal ends of rods 78*a* of the actuators 78 are pivotally mounted on the rear surface of the plate catch 75. When the rods 78*a* of the actuators 78 are moved backward, the plate catch 75 pivots clockwise in FIG. 3 about the hinges 76 as the pivot center to close the lower portion of the opening 58*a*. When the rods 78*a* of the actuators 78 are moved forward, the plate catch 75 pivots counterclockwise in FIG. 3 about the hinges 76 as the pivot center to open the lower portion of the opening 58*a*.

Figure 14B:
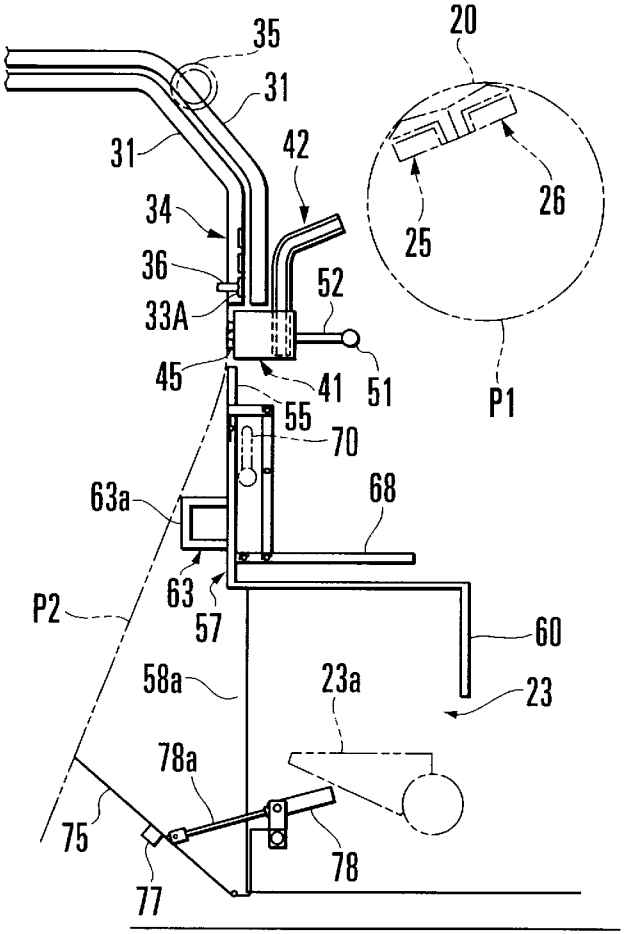
FIGS. 14A and 14B are sectional views taken along the line XIIII—XIIII of FIG. 2 to show states in full-automatic plate exchanging operation wherein a new plate is set on the plate holder and a plate catch is opened, respectively.
Figure 14A:
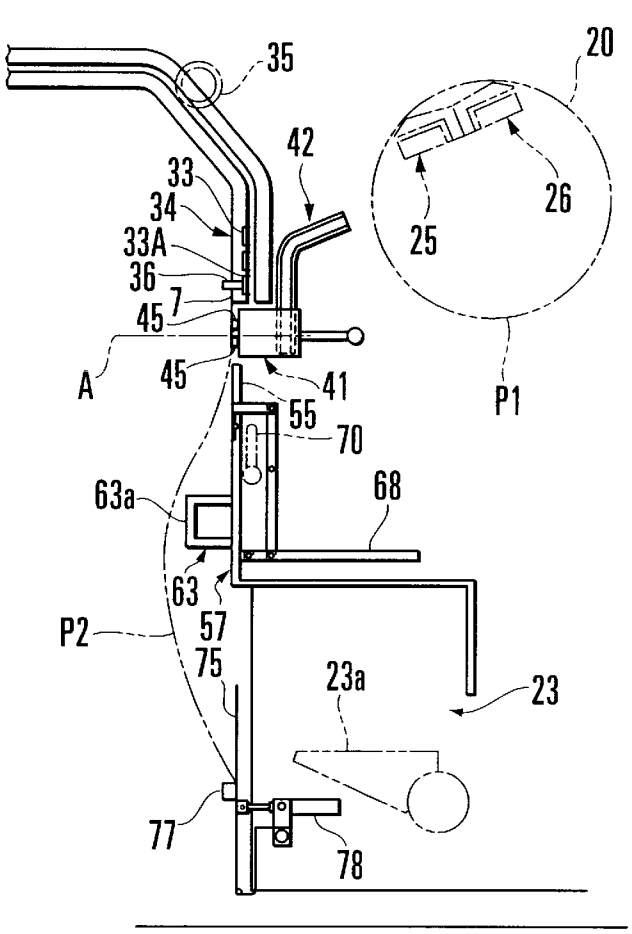

As shown in FIG. 14A, when the plate catch 75 is closed, as the leading edge of the new plate P2 is to be drawn by suction with the suction pads 45 of the plate holder 41, the support members 77 support the trailing edge of the new plate P2, as will be described later. From this state, when the plate catch 75 is opened as shown in FIG. 14B, the trailing edge of the new plate P2 separates from the support members 77, and abuts against the distal end of the plate catch 75 to be supported by it. At the same time, the trailing edge of the removed old plate P1 is supported by the rear surface of the plate catch 75, as will be described later.

Figure 9:
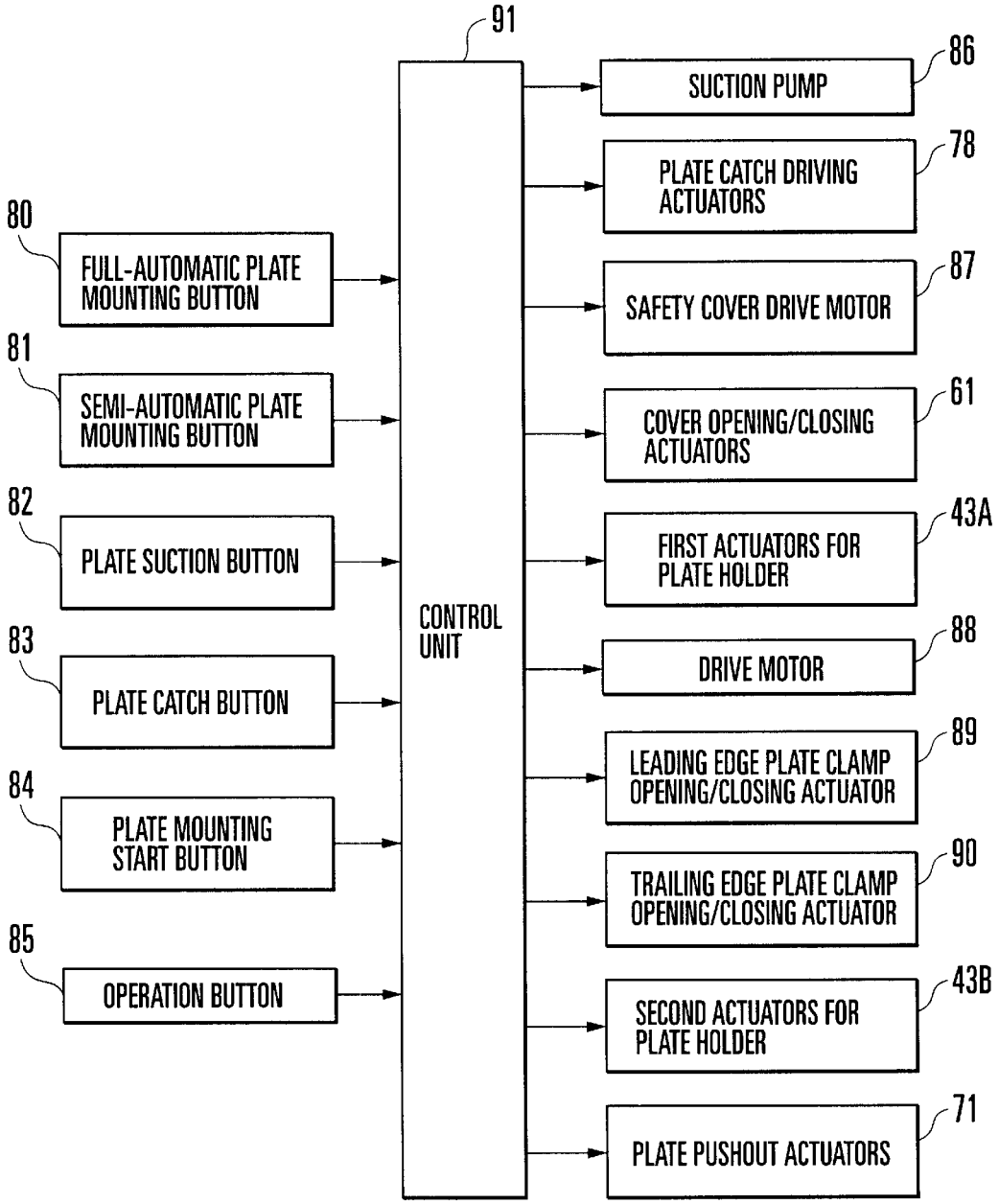
FIG. 9 is a block diagram of the main part of the rotary printing press according to the present invention to show its electric arrangement.
Figure 10:
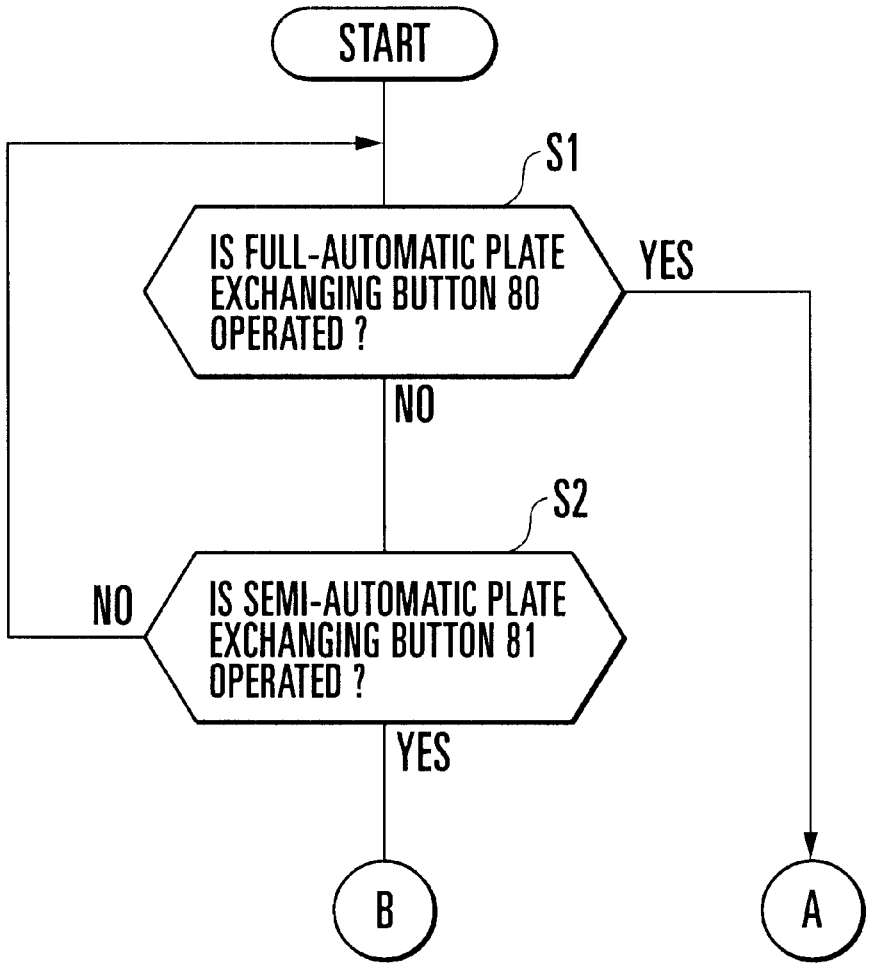
FIG. 10 is a flow chart showing selection between full-automatic plate mounting and semi-automatic plate mounting in the rotary printing press according to the present invention.
Figure 11:
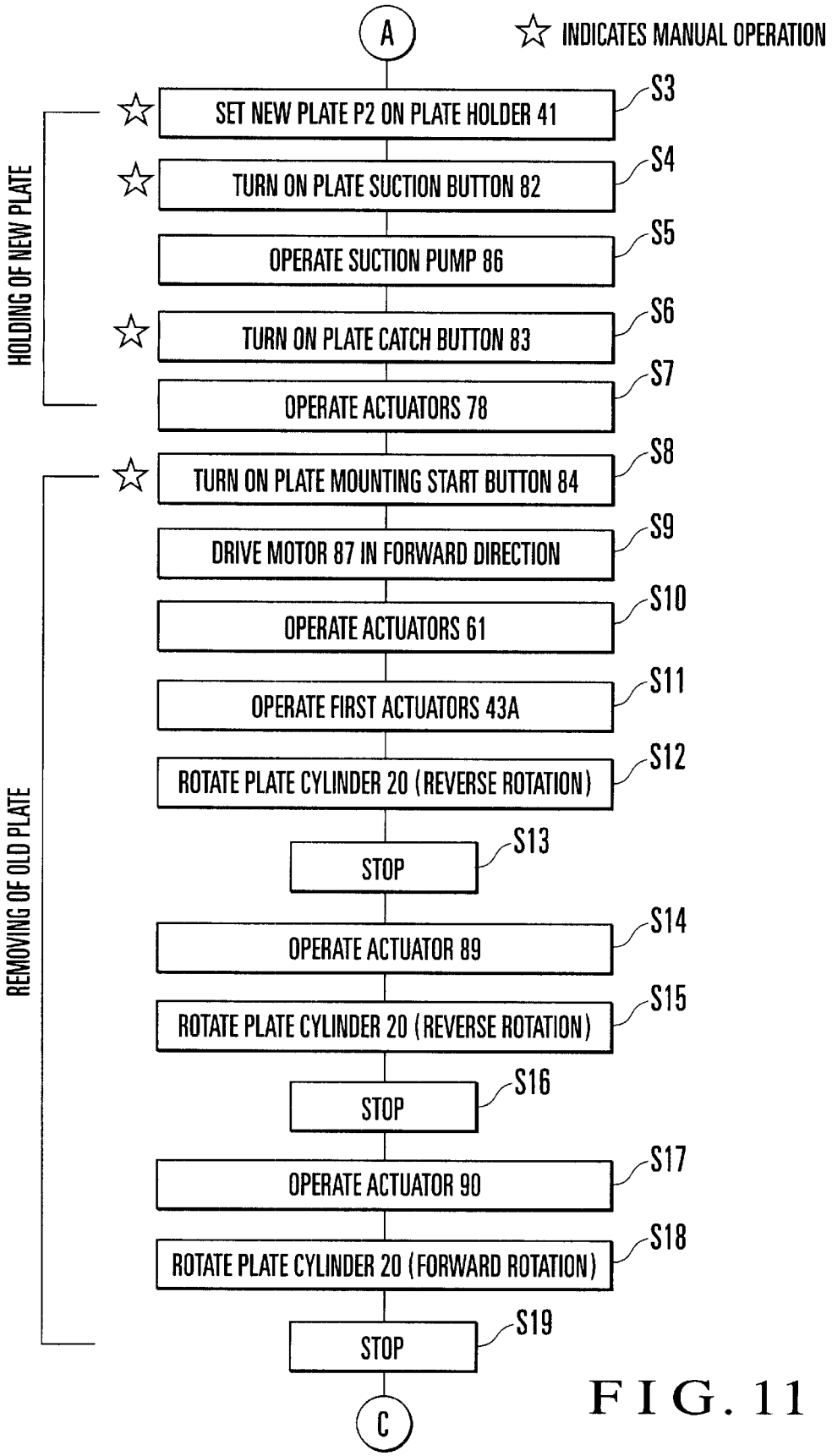
FIG. 11 is a flow chart showing the operation of full-automatic plate mounting in the rotary printing press according to the present invention.
Figure 12:
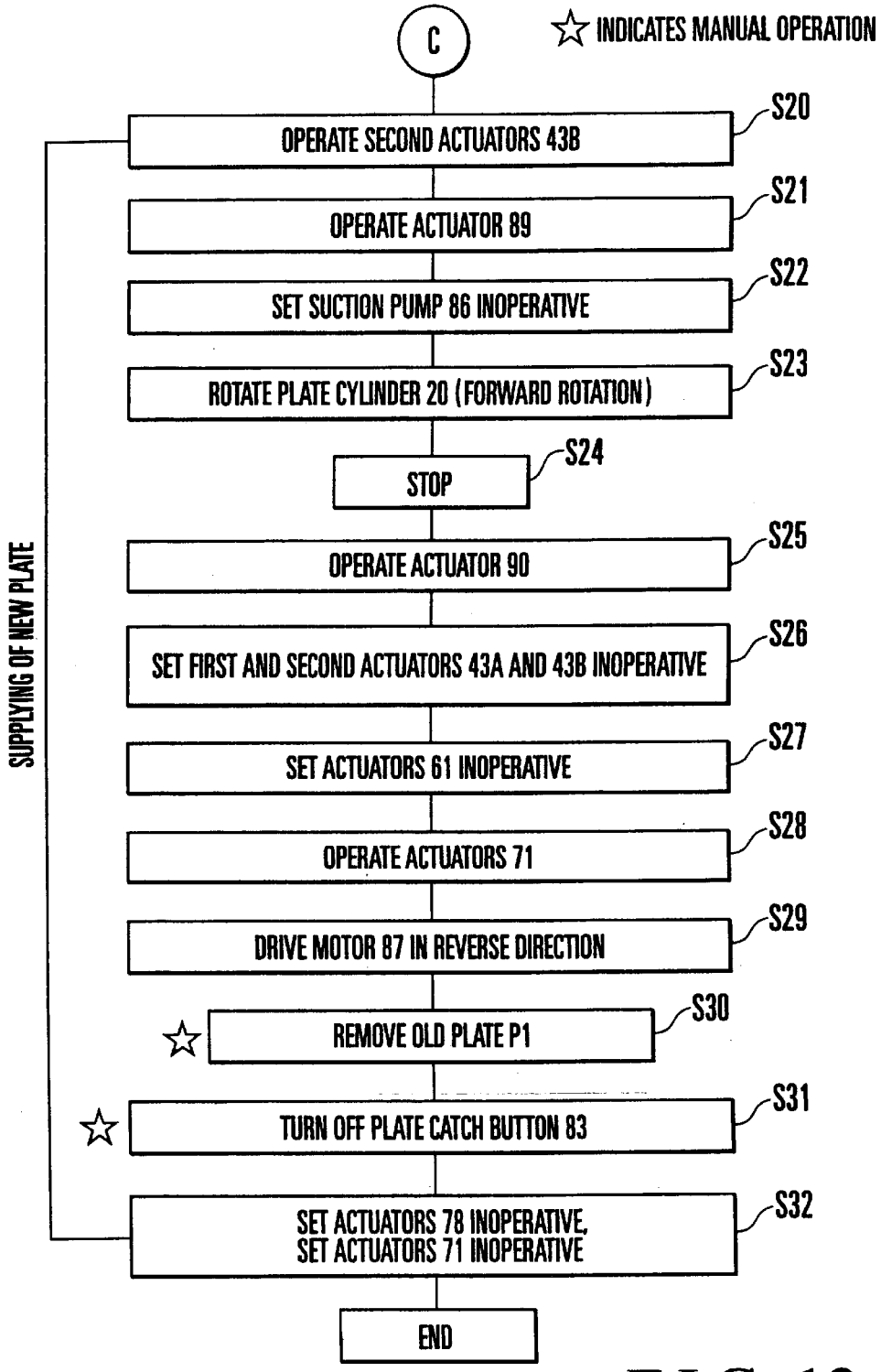
FIG. 12 is a flow chart following FIG. 11 to show the operation of full-automatic plate mounting.
Figure 13:
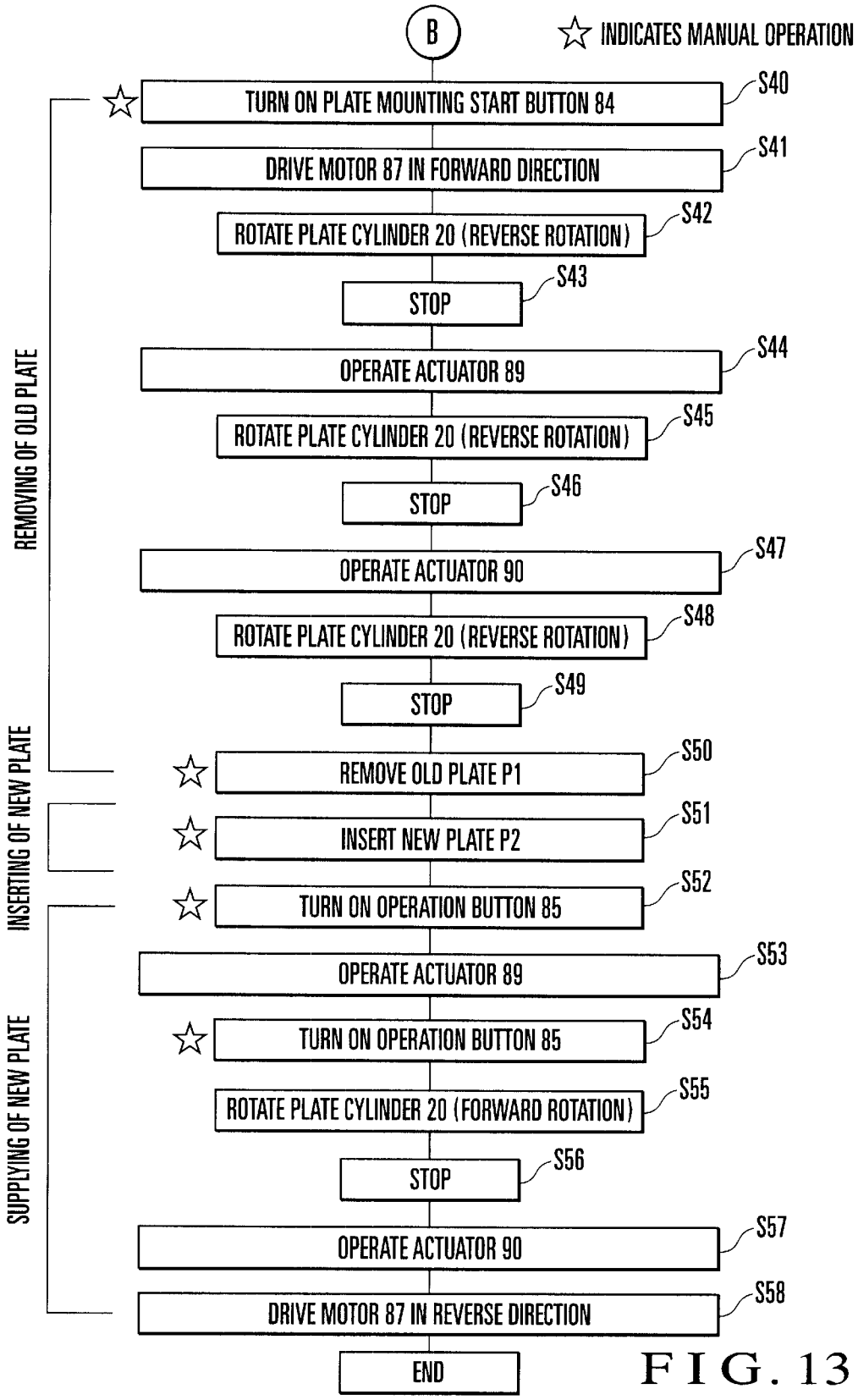
FIG. 13 is a flow chart showing the operation of semi-automatic plate mounting in the rotary printing press according to the present invention.

FIG. 9 shows the main part of the rotary printing press. Referring to FIG. 9, the rotary printing press has a full-automatic plate mounting button 80, a semi-automatic plate mounting button 81, a plate suction button 82 for operating the suction pump 86, and a plate catch button 83 for operating the actuators 78. A plate mounting start button 84 automatically removes the old plate and starts the operation of supplying the new plate in the full-automatic plate exchanging mode. An operation button 85 drives leading and trailing edge plate clamp opening/closing actuators 89 and 90 in order to supply the new plate P2 in the semi-automatic plate exchanging mode. A drive motor 88 rotates all the cylinders of the printing press. When exchanging the plate, the drive motor 88 rotates the plate cylinder 20 for a predetermined amount in the forward/reverse directions. A control unit 91 controls the operations of the actuators and the like described above upon operation of the buttons described above.

The actuator 89 serves to open/close the leading edge plate clamp. When the actuator 89 is operated, the leading edge cam shaft (not shown) of the leading edge plate clamp 25 in FIG. 3 pivots in the forward/reverse directions by a predetermined amount through a lever (not shown). When the leading edge cam shaft pivots, the gripper board 25*b* swings to grip and release the leading edge of the plate with the bottom clamping rail 25*a*. When the trailing edge plate clamp actuator 90 is operated, the trailing edge cam shaft (not shown) of the trailing edge plate clamp 26 in FIG. 3 pivots in the forward/reverse directions by a predetermined amount through a lever. When the trailing edge cam shaft pivots, the gripper board 26*b* swings to grip and release the trailing edge of the plate with the bottom clamping rail 26*a*.

The operation of changing the plate full-automatically will be described with reference to FIGS. 10, 11, 12, and 14A to 17B.

As shown in FIG. 14A, the first and second actuators 43A and 43B are set inoperative to position the plate holder 41 at the first position. The full-automatic plate mounting button 80 is turned on to select full-automatic plate exchanging mode (step S1 in FIG. 10). In FIG. 14A, the trailing edge of the new plate P2 is placed and supported on the support members 77 of the plate catch 75, and the leading edge of the substantially vertical new plate P2 is set on the suction pads 45 of the plate holder 41 from the outside of the guide 63*a* of the guide member 63 (step S3 in FIG. 11). Hence, the notches 7 of the new plate P2 engage with the reference pins 36 of the lowermost blocking plate 33A of the safety cover 34. At this time, since the new plate P2 is deflected between the support members 77 and reference pins 36, its notches 7 are pushed by the reference pins 36 so that the new plate P2 is reliably positioned before set by the plate holder 41.

Then, the plate suction button 82 is turned on (step S4) to operate the suction pump 86 (step S5). The leading edge of the new plate P2 is drawn by suction with the suction pads 45 of the plate holder 41, so that the new plate P2 is held by the plate holder 41. At this time, the suction force of the suction pump 86 is adjusted to such a degree that the new plate P2 is drawn by suction to be slidable with respect to the suction pads 45. When the plate catch button 83 is turned on (step S6), the actuators 78 are operated to move the rods 78*a* forward (step S7).

Hence, as shown in FIG. 14B, the plate catch 75 is opened, and the trailing edge of the new plate P2 is unfixed from the support members 77. The new plate P2 is accordingly supported on the distal end of the plate catch 75 in a slightly inclined state. The holding operation of the new plate P2 is thus completed. At this time, since the leading edge of the new plate P2 is held by the plate holder 41 and the trailing edge thereof is supported on the distal end of the plate catch 75, the rear surface of the upper portion of the new plate P2 covers the removal path of the old plate P1 (to be described later) which is to be removed from the old plate removal port 62.

Figure 15B:
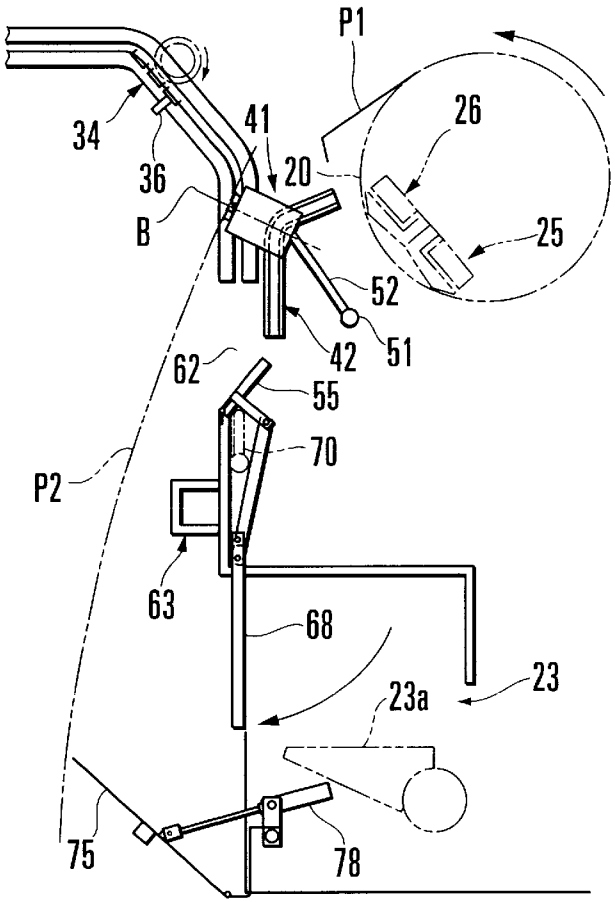
FIGS. 15A and 15B are sectional views taken along the line XIIII—XIIII of FIG. 2 to show states in full-automatic plate exchanging operation wherein a safety cover is opened and the plate holder is moved to the second position, respectively.
Figure 15A:
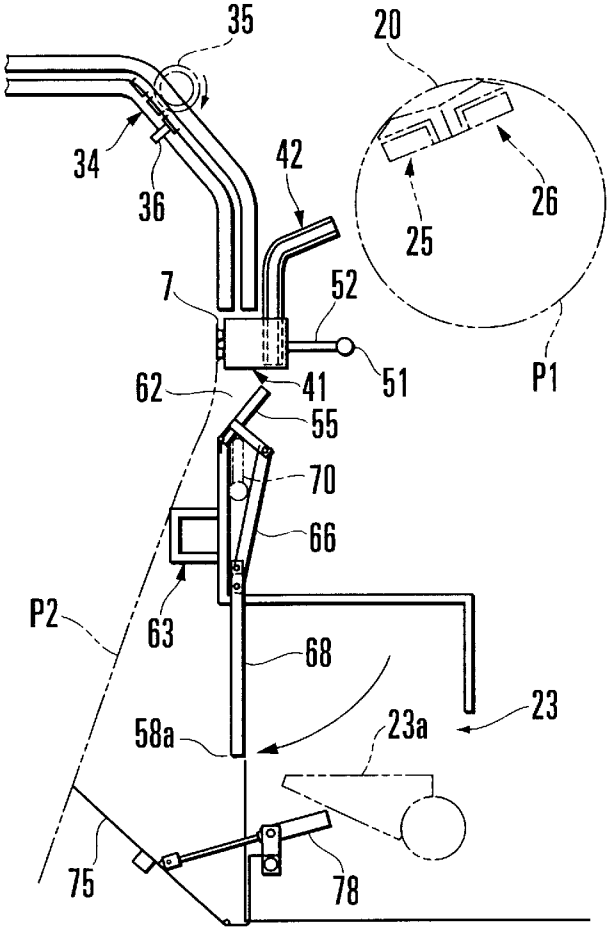

When the plate mounting start button 84 is turned on (step S8), the safety cover drive motor 87 is driven in the forward direction (step S9), and the sprockets 35 rotate clockwise, as shown in FIG. 15A. Hence, the safety cover 34 moves upward to open the front surface of the plate cylinder 20, and the reference pins 36 of the blocking plate 33A disengage from the notches 7 of the new plate P2.

The actuators 61 are then operated (step S10) to pivot the plate removal cover 55 such that its upper end falls toward the plate cylinder 20, thereby opening the old plate removal port 62. Simultaneously, as the plate removal cover 55 falls, the plate approach regulating members 68 pivot through the link members 66. The pivoting plate approach regulating members 68 close the upper portion of the opening 58*a*. The first actuators 43A are operated (step S11) to position the plate holder 41 at the point B as the second position, as shown in FIG. 15B. At the second position, the plate holder 41 is switched to the second posture that allows removal of the old plate P1, as described above.

The drive motor 88 is driven in the reverse direction (step S12) to pivot the plate cylinder 20 in the reverse direction by a predetermined amount. When the plate cylinder 20 stops (step S13), the actuator 89 is operated (step S14) to open the leading edge plate clamp 25 of the plate cylinder 20, thereby releasing the gripped leading edge of the old plate P1. Subsequently, the plate cylinder 20 pivots in the reverse direction by a predetermined amount and stops (steps S15 and S16). After that, the actuator 90 is operated (step S17) to open the trailing edge plate clamp 26 of the plate cylinder 20, thereby releasing the gripped trailing edge of the old plate P1. Subsequently, when the plate cylinder 20 rotates in the reverse direction (step S18), the trailing edge of the old plate P1 is unfixed from the plate cylinder 20 and is guided by the plate removal cover 55, so that the old plate P1 is removed outside the printing press through the old plate removal port 62.

As shown in FIG. 16A, when the old plate P1 is removed, its trailing edge is guided downward along the inner side of the guide 63*a* of the guide member 63. The leading edge of the old plate P1 disengages from the leading edge plate clamp 25, and the trailing edge of the old plate P1 is supported by the plate catch 75. At this time, since the trailing edge of the old plate P1 is detected by the photosensors 77*a*, it is confirmed that the old plate P1 is stored in the plate catch 75, and the control unit 91 stops rotation of the plate cylinder 20 upon reception of output signals from the photosensors 77*a* (step S19). In this manner, since completion of removal of the old plate P1 is detected by the photosensors 77*a*, the next new plate P2 can be supplied safely and reliably.

At this time, the leading edge plate clamp 25 faces the end faces of the straight portions 42*c* of the guide rails 42. When the actuators 43B are operated (step S20), the plate holder 41 moves to the straight portion 42*c* of each guide rail 42, as shown in FIG. 16B, and is positioned at the third point C. The inclination of the straight portion 42*c* and the inclination of the upper end face of the bottom clamping rail 25*a* of the leading edge plate clamp 25 become substantially equal, and the upper end face of the bottom clamping rail 25*a* is located on the extension of the suction surfaces of the suction pads 45 of the plate holder 41 positioned by the straight portions 42*c*. Hence, the leading edge of the new plate P2 drawn by suction with the suction pads 45 is inserted between the bottom clamping rail 25*a* and gripper board 25*b*.

At this time, the plate holder 41 is positioned at the third point C such that the notches 7 of the new plate P2 are pushed by the reference pins 27. When the notches 7 of the new plate P2 engage (come into contact) with the reference pins 27, the plate holder 41 pushes the new plate P2 toward the reference pins 27, while sliding on the new plate P2, against the suction force of the suction pads 45. Therefore, the notches 7 of the new plate P2 are further urged against the reference pins 27, and the new plate P2 is positioned to face the leading edge plate clamp 25. Subsequently, the actuator 89 is operated (step S21), and the leading edge of the new plate P2 is gripped between the gripper board 25*b* and bottom clamping rail 25*a*.

Regarding insertion of the new plate P2 to the leading edge plate clamp 25, since the guide rails 42 have the curved portions 42*b* in addition to the straight portions 42*c* that serve for plate insertion, the guide rails 42 do not project between the adjacent printing units more than necessary. Thus, the plate holder 41 positioned at a position other than the third position where the new plate P2 is to be inserted does not project between the adjacent printing units. As a result, the work space between the adjacent printing units is not narrowed, and the workability of maintenance and inspection is improved.

Since the guide rails 42 have the straight portions 42*a* serving to set the new plate, the suction surfaces of the suction pads 45 of the plate holder 41 positioned at the first position become vertical. Hence, in the operation of holding the new plate P2 with the suction pads 45, since the new plate P2 can also be set in the vertical state by its own weight and drawn by suction with the suction pads 45, it can be set on the plate holder 41 easily. Since the new plate P2 is held by the plate holder 41 only at its leading edge, the plate holder 41 itself can be downsized.

Figure 17B:
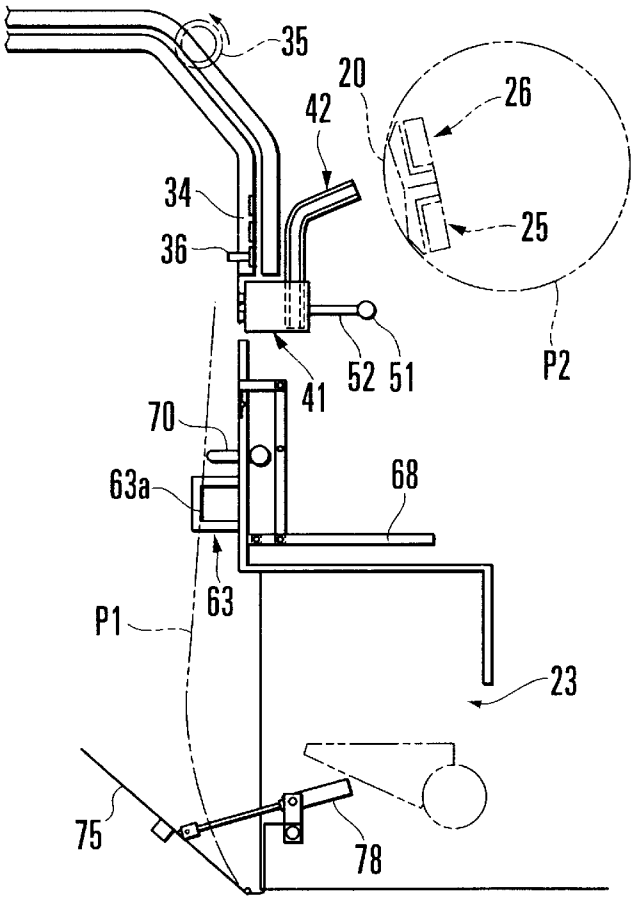
FIGS. 17A and 17B are sectional views taken along the line XIIII—XIIII of FIG. 2 to show states in full-automatic plate exchanging operation wherein the new plate is set on the plate cylinder and the safety cover is closed, respectively.
Figure 17A:
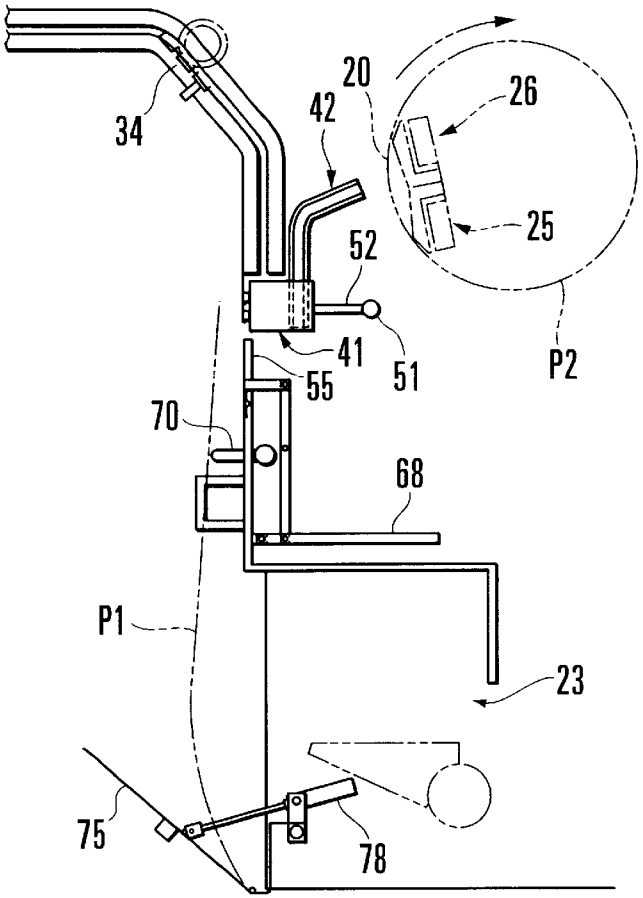

When the suction pump 86 becomes inoperative (step S22), the new plate P2 drawn by suction with the suction pads 45 of the plate holder 41 is released. Therefore, the new plate P2 is held only by the leading edge plate clamp 25. Subsequently, the plate cylinder 20 pivots in the forward direction by a predetermined amount and stops (steps S23 and S24). After that, the actuator 90 is operated (step S25) to grip the trailing edge of the new plate P2 with the gripper board 26*b* and bottom clamping rail 26*a*, and the new plate P2 is set on the plate cylinder 20, as shown in FIG. 17A. Both the first and second actuators 43A and 43B become inoperative (step S26), and the plate holder 41 is moved from the third position to the first position along the guide rails 42 and positioned there, as shown in FIG. 17B.

Then, the actuators 61 become inoperative (step S27), and the plate removal cover 55 closes the old plate removal port 62. When the actuators 71 are operated (step S28), the plate pushout members 70 project from the windows 64 of the stationary cover 57, and the leading edge of the removed old plate P1 is pushed by the plate pushout members 70 to the outside of the stationary cover 57. The motor 87 is then driven in the reverse direction (step S29) so that the safety cover 34 moves downward to close the front surface of the plate cylinder 20.

The operator manually removes the old plate P1 (step S30), and turns off the plate catch button 83 (step S31). Thus, the actuators 78 become inoperative (step S32), and the plate catch 75 pivots to close the lower portion of the opening 58*a*. Simultaneously, the actuators 71 become inoperative, and the plate pushout members 70 are stored in the stationary cover 57.

The operation of exchanging the plate in the semi-automatic manner will be described with reference to FIGS. 10, 13, and 18A to 21.

Figure 18B:
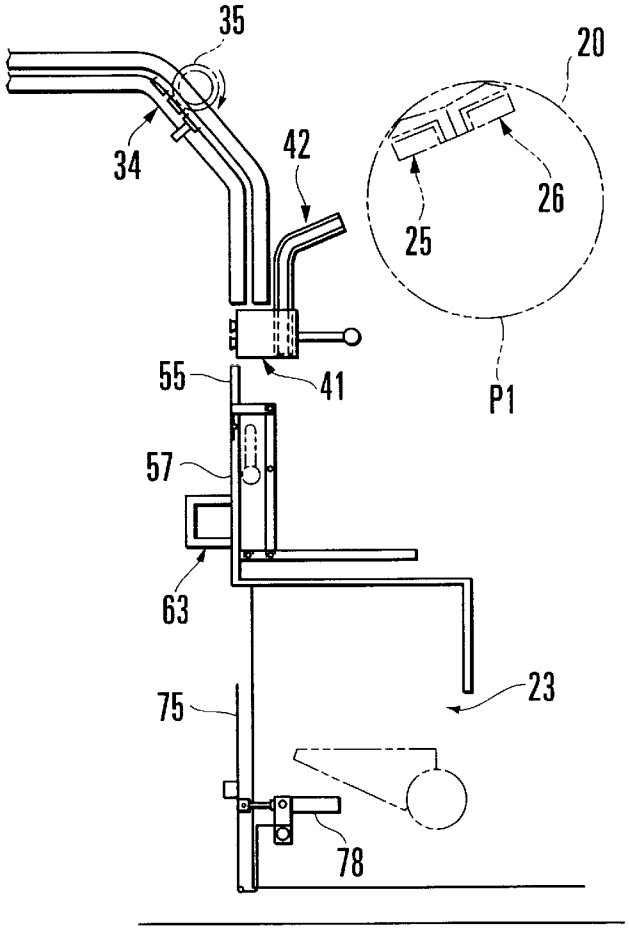
FIGS. 18A and 18B are sectional views taken along the line XIIII—XIIII of FIG. 2 to show states in semi-automatic plate exchanging operation wherein the safety cover is closed and opened, respectively.
Figure 18A:
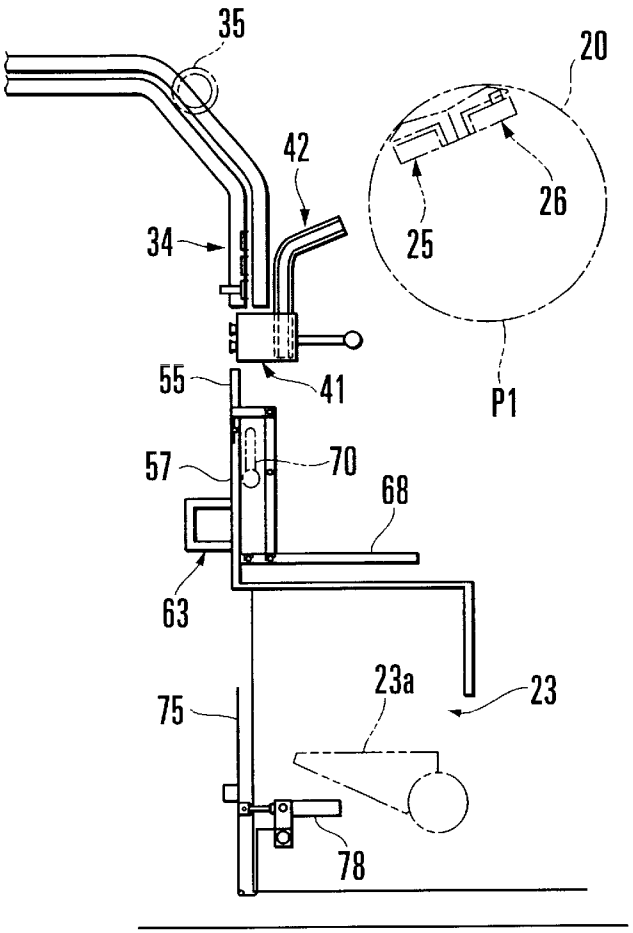

If the full-automatic plate mounting button 80 is not turned on but the semi-automatic plate mounting button 81 is turned on (step S2 in FIG. 10), semi-automatic plate exchanging mode is selected. When the plate mounting start button 84 is turned on (step S40), the motor 87 is driven in the forward direction (step S41). Hence, from the closed state shown in FIG. 18A, the safety cover 34 moves upward, as shown in FIG. 18B, to open the front surface of the plate cylinder 20. The plate cylinder 20 pivots in the reverse direction by a predetermined amount and stops (steps S42 and S43). After that, the actuator 89 is operated (step S44) to open the leading edge plate clamp 25 of the plate cylinder 20, so that the gripped leading edge of the old plate P1 is released.

Figure 19B:
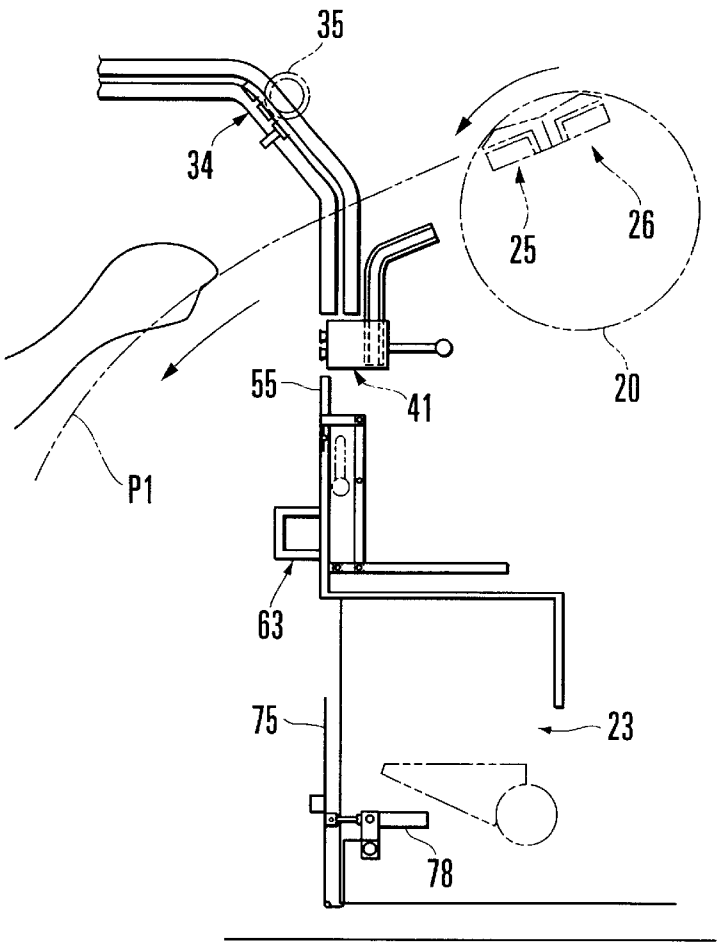
FIGS. 19A and 19B are sectional views taken along the line XIIII—XIIII of FIG. 2 to show states in semi-automatic plate exchanging operation wherein the fixed old plate is unfixed from the plate fixing unit of the plate cylinder and the old plate is being removed, respectively.
Figure 19A:
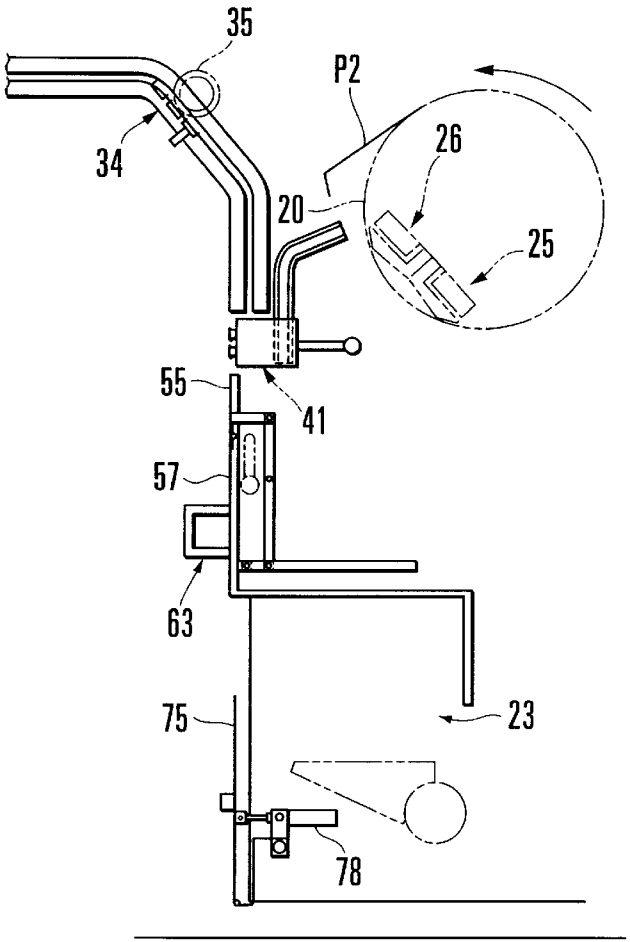

When the plate cylinder 20 pivots in the reverse direction by a predetermined amount and stops (steps S45 and S46), the trailing edge plate clamp opening/closing actuator 90 is operated (step S47) to open the trailing edge plate clamp 26 of the plate cylinder 20, so that the gripped trailing edge of the old plate P1 is released. When the plate cylinder 20 subsequently rotates in the reverse direction (step S48), the trailing edge of the old plate P1 is unfixed from the plate cylinder 20, as shown in FIG. 19A. Hence, the operator manually holds the trailing edge of the old plate P1, as shown in FIG. 19B. When the plate cylinder 20 subsequently rotates in the reverse direction through substantially one revolution and stops (step S49), the leading edge of the old plate P1 is also unfixed from the plate cylinder 20. Thus, the operator manually removes the old plate P1 (step S50).

Figure 20B:
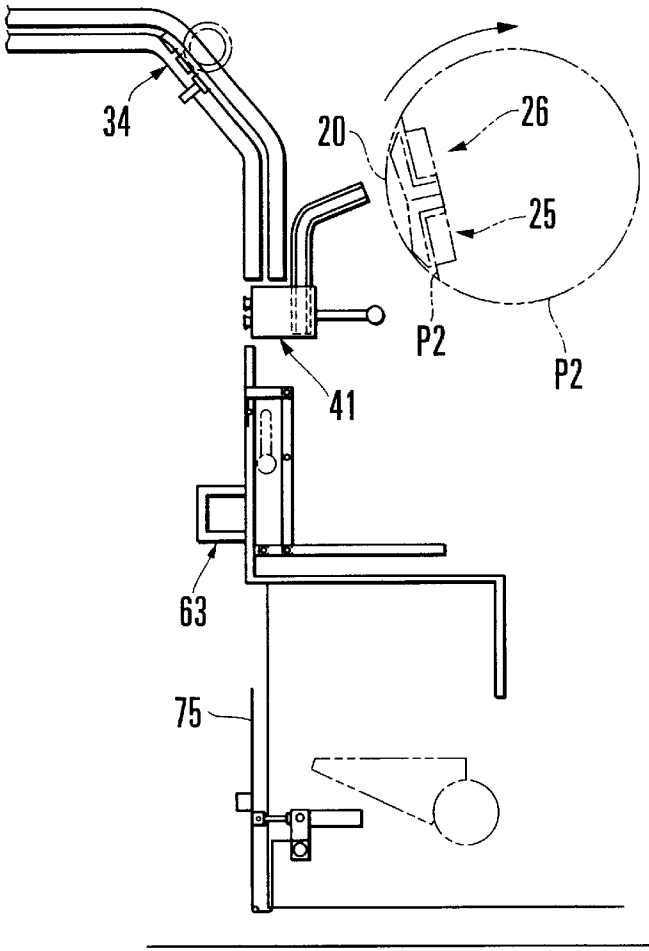
FIGS. 20A and 20B are sectional views taken along the line XIIII—XIIII of FIG. 2 to show states in semi-automatic plate exchanging operation wherein the new plate is being inserted in the plate fixing unit of the plate cylinder and the new plate is set on the plate cylinder, respectively.
Figure 20A:
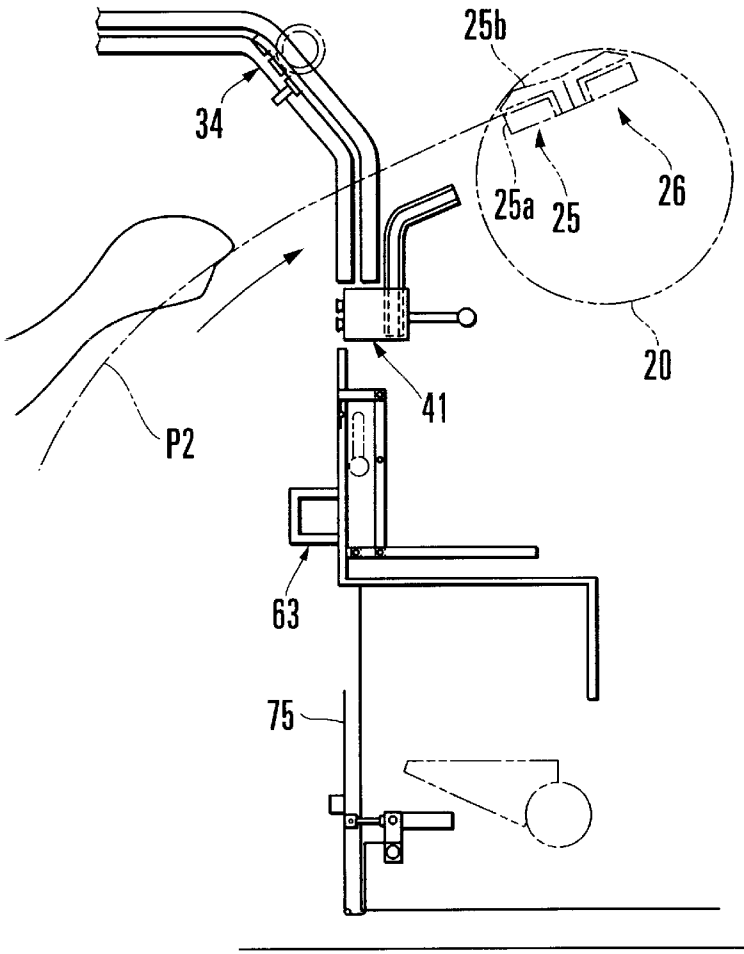

The operator then manually holds the new plate P2 (step S51), inserts it between the bottom clamping rail 25*a* and gripper board 25*b* of the leading edge plate clamp 25 of the plate cylinder 20, as shown in FIG. 20A, and turns on the operation button 85 (step S52). When the actuator 89 is operated (step S53), the trailing edge of the new plate P2 is gripped by the gripper board 25*b* and bottom clamping rail 25*a*. When the operator turns on the operation button 85 again (step S54), the plate cylinder 20 pivots in the forward direction by a predetermined amount, and stops, as shown in FIG. 20B (steps S55 and S56).

Figure 21:
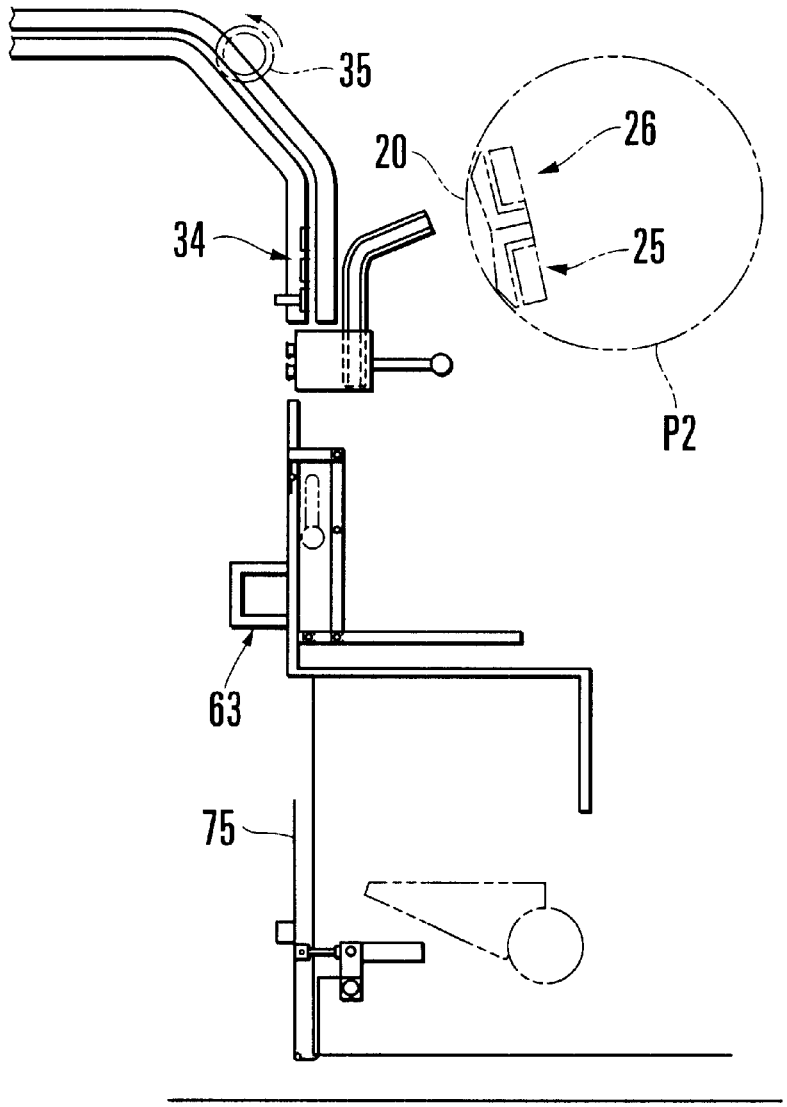
FIG. 21 is a sectional view taken along the line XIIII—XIIII of FIG. 2 to show a state in semi-automatic plate exchanging operation wherein the safety cover is closed.

The trailing edge plate clamp actuator 90 is then operated (step S57) to pivot a trailing edge cam shaft 26*c*. The trailing edge of the new plate P2 is thus gripped by the gripper board 26*b* and bottom clamping rail 26*a*, and the new plate P2 is set on the plate cylinder 20. The motor 87 is then driven in the reverse direction (step S58), so that the safety cover 34 moves downward to close the front surface of the plate cylinder 20, as shown in FIG. 21.

Figure 22A:
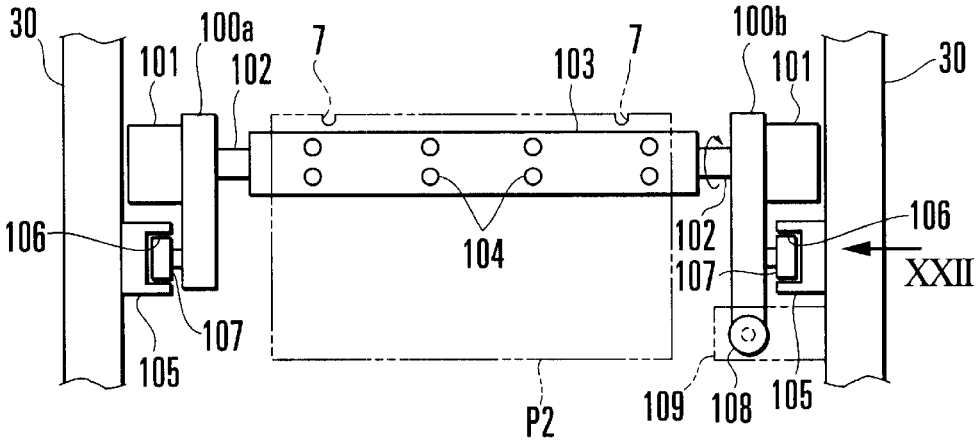
FIG. 22A is a front view showing the main part of a plate inserting apparatus according to the second embodiment of the present invention.
Figure 22B:
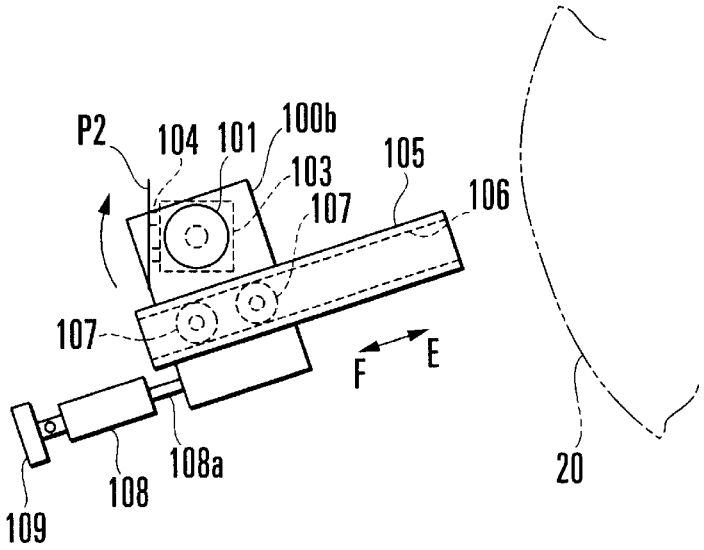
FIG. 22B is a view seen from the arrow XXIIB of FIG. 22A.

FIGS. 22A and 22B show the second embodiment of the present invention.

Referring to FIG. 22A, a pair of rotary actuators 101 serving as posture changing means are fixed to the outer sides of a pair of opposing side plates 100*a* and 100*b*, respectively. Rotary shafts 102 of the rotary actuators 101 extend through the side plates 100*a* and 100*b* to project inward. A large number of suction pads 104 are formed on the front surface of a plate holder 103, and the projecting ends of the rotary shafts 102 of the rotary actuators 101 are fixed to the right and left ends of the plate holder 103. When the rotary actuators 101 are operated, the plate holder 103 is changed among the first posture shown in FIG. 22B, the second posture at which it has pivoted clockwise in FIG. 22B through substantially 45°, and the third posture at which it has further pivoted clockwise through 45°.

A pair of linear guide rails 105 are fixed to the inner sides of frames 30. Rollers 107 rotatably supported on the outer sides of the side plates 100*a* and 100*b* engage in guide grooves 106 of the guide rails 105. When the rollers 107 slide along the guide grooves 106 of the guide rails 105, the plate holder 103 can move in the directions of arrows E - F through the two side plates 100*a* and 100*b*. A moving actuator 108 is fixed to a bracket 109 with a proximal end attached to the frame 30. The distal end of a rod 108*a* of the actuator 108 is attached to the end face of the side plate 100*b*.

In this arrangement, to insert a new plate P2 in the leading edge plate clamp of a plate cylinder 20, first, the leading edge of the new plate P2 is drawn by suction with the suction pads 104 of the plate holder 103 in the first posture so that it is held by the plate holder 103. The rotary actuators 101 are then operated to set the plate holder 103 in the second posture. As a result, the old plate can be removed in the same manner as in the first embodiment. The rotary actuators 101 are further operated to set the plate holder 103 in the third posture, and the rod 108*a* of the moving actuator 108 is moved forward, thereby inserting the new plate P2 drawn by suction with the suction pads 104 into the leading edge plate clamp of the plate cylinder 20.

Figure 23A:
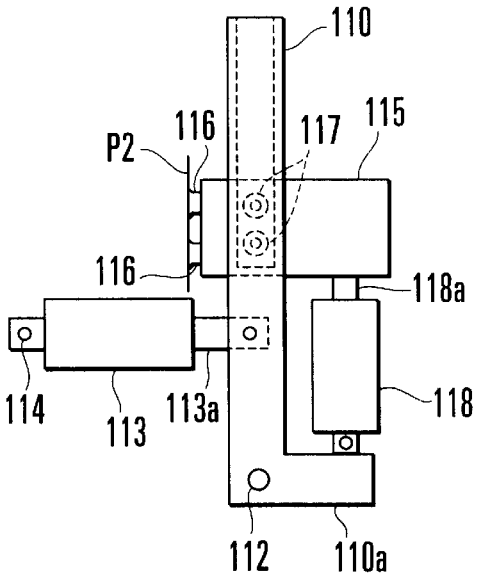
FIGS. 23A and 23B are a side view and developed front view, respectively, showing a plate inserting apparatus according to the third embodiment of the present invention.
Figure 23B:
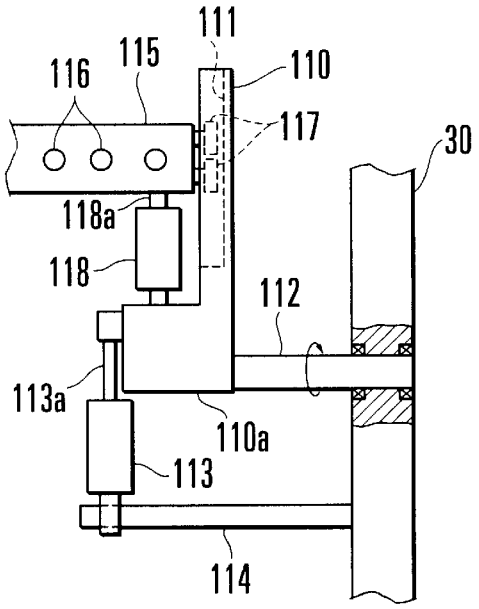
Figure 23C:
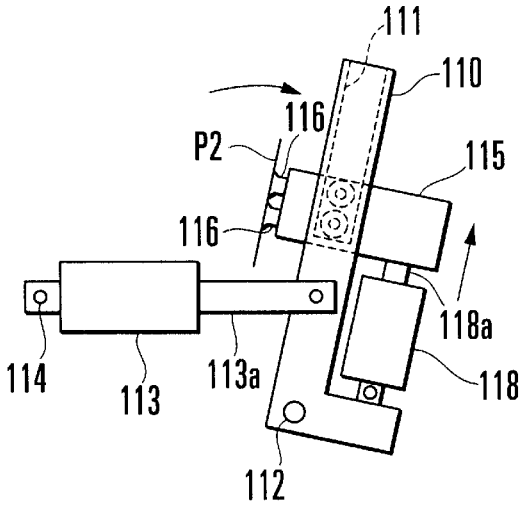
FIG. 23C is a side view for explaining an operating state.

FIGS. 23A, 23B, and 23C show the third embodiment of the present invention.

Referring to FIGS. 23A and 23B, a pair of guide rails 110 are pivotally supported by frames 30 through shafts 112 standing vertically on their proximal ends 110*a*. Linear guide grooves 111 are formed in the free ends of the guide rails 110. An actuator 113 serving as a posture changing means has one end pivotally mounted to the corresponding frame 30 through a shaft 114. The distal end of a rod 113*a* is pivotally mounted to the guide rail 110.

A plate holder 115 has a large number of suction pads 116 on its front surface. Rollers 117 are rotatably supported at the right and left ends of the plate holder 115. As the rollers 117 engage with the guide grooves 111 of the guide rails 110, the plate holder 115 is supported to be movable along the guide rails 110. A moving actuator 118 has a lower end fixed to the proximal end 110*a* of the guide rail 110. The distal end of a rod 118*a* of the actuator 118 is attached to the plate holder 115.

In this arrangement, as shown in FIG. 23A, when both the rods 113*a* and 118*a* of the two actuators 113 and 118 have moved backward, the plate holder 115 is positioned at the first position where the new plate P2 is to be set on the plate holder 115. From this first position, when the rod 113*a* of the actuator 113 is moved forward as shown in FIG. 23C, the guide rails 110 pivot clockwise in FIG. 23C about the shafts 112 as the pivot center. Thus, the plate holder 115 also pivots together with the guide rails 110, and is positioned at the second position where the new plate P2 to be held by the plate holder 115 is retreated from the remove path for the old plate. When the rod 118*a* of the actuator 118 is moved forward from the second position, the plate holder 115 moves along the guide grooves 111 of the guide rails 110 through the rollers 117. Thus, the plate holder 115 is positioned at the third position where the new plate P2 is to be inserted in the leading edge plate clamp of the plate cylinder.

Figure 24A:
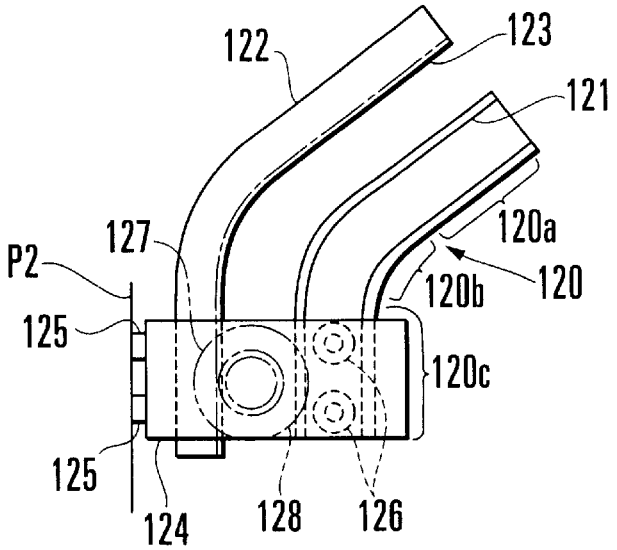
FIGS. 24A and 24B are a side view and developed front view, respectively, showing the main part of a plate inserting apparatus according to the fourth embodiment of the present invention.
Figure 24B:
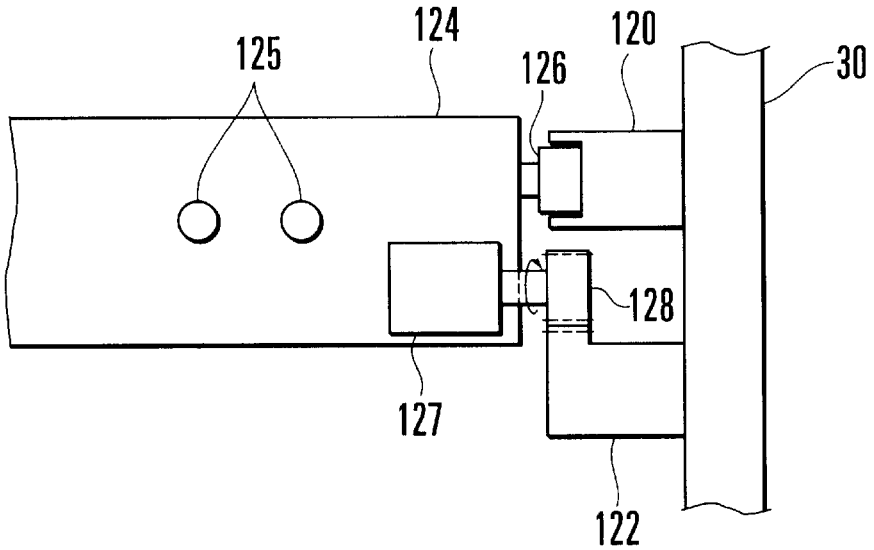

FIGS. 24A and 24B show the fourth embodiment of the present invention.

Referring to FIGS. 24A and 24B, each of a pair of right and left guide rails 120 having guide grooves 121 is comprised of a substantially vertical straight portion 120*a*, a curved portion 120*b*, and a straight portion 120*c* inclined upward toward a plate cylinder 20. A pair of rack members 122 fixed to a pair of frames 30 respectively have racks 123 formed with the same radius of curvature as that of the guide grooves 121 of the guide rails 120. A plate holder 124 has a large number of suction pads 125 on its front surface, and rollers 126 are rotatably supported at the right and left ends of the plate holder 124. When the rollers 126 engage with the guide grooves 121 of the guide rails 120, the plate holder 124 is supported to be movable along the guide rails 120. A pinion 128 is axially mounted on the motor shaft of a motor 127 which is driven in the forward/reverse directions. The motor 127 is fixed to the plate holder 124 such that the pinion 128 meshes with the rack 123 of the rack member 122.

In this arrangement, in the state of FIG. 24A wherein the plate holder 124 is located at the straight portion 120*a* of the guide rail 120, the plate holder 124 is positioned at the first position where the new plate P2 is to be set on it. From this state, when the motor 127 is driven in the reverse direction, the pinion 128 pivots counterclockwise in FIG. 24A. Hence, the plate holder 124 moves upward and is positioned across the curved portion 120*b* and straight portion 120*c* of the guide rail 120, so that the plate holder 124 is positioned at the second position where the old plate can be removed and the third position where the new plate can be inserted in the leading edge plate clamp of the plate cylinder.

In the above embodiments, the present invention is applied to a sheet-fed rotary printing press for printing on sheet paper. The present invention can also be applied to a web rotary printing press for printing on a web.

As has been described above, according to the present invention, no cassette having the new plate setting unit and old plate storage unit is required. The work space between the printing units will not be narrowed to improve workability in maintenance and inspection. A large driving unit for driving the cassette is not required to attain a compact, simple apparatus.

What is claimed is:

1. A plate exchanging apparatus in a rotary printing press, comprising:

a plate fixing unit provided to a plate cylinder;

a plate holder for holding a new plate before inserting to said plate fixing unit; and actuator means for moving said plate holder to selectively position said plate holder at a first position apart from the plate cylinder, a third position close to the plate cylinder and a second position between the first and third positions, wherein when the plate holder is located at the first position, the new plate is held substantially on an old plate removal path by said plate holder, wherein when the plate holder is located at the second position, the new plate held by said plate holder is retreated from the old plate removal path, and wherein when the plate holder is located at the third position, the new plate held by said plate holder is inserted into said plate fixing unit.

2. The apparatus according to claim 1, wherein the first, second, and third positions of the plate holder are arranged at different angles.

3. The apparatus according to claim 2, wherein the new plate held by said plate holder is substantially vertically held when said plate holder is located at the first position, held spaced apart from the old plate removal path when said plate holder is located at the second position, and held to have the same inclination as that of a fixing surface of said plate fixing unit which is located at a predetermined plate insertion position when said plate holder is located at the third position.

4. The apparatus according to claim 1, wherein said apparatus further comprises a reference pin provided to said plate fixing unit to position the new plate, and said plate holder urges the new plate against said reference pin when said plate holder is located at the third position.

5. The apparatus according to claim 4, wherein when the new plate abuts against said reference pin while the new plate is being inserted, said plate holder slides on the new plate against a holding force, thereby further urging the new plate against said reference pin.

6. The apparatus according to claim 1, wherein when the plate holder is located at the second position, said plate holder holds the new plate in a position to prevent an old plate from jumping out from the old plate removal path.

7. The apparatus according to claim 1, wherein the plate cylinder is provided in a printing unit having an old plate removal port, and wherein the old plate removal path is formed outside of the printing unit through the old plate removal port from the plate cylinder.

8. A plate exchanging apparatus in a rotary printing press, comprising:

a plate fixing unit provided to a plate cylinder;

a plate holder for holding a new plate before inserting to said plate fixing unit;

actuator means for moving said plate holder to selectively position said plate holder at a first position apart from the plate cylinder, a third position close to the plate cylinder and a second position between the first and third positions;

a first plate support member disposed below said plate holder to hold a trailing edge of the new plate whose leading edge is held by said plate holder when said plate holder is located at the first position; and a second plate support member fixed to said first plate support member to support the trailing edge of the new plate, whose leading edge is held by said plate holder, such that the trailing edge is spaced apart from an old plate removal path, when said plate holder is located at the first position, wherein when the plate holder is located at the first position, the new plate is held by said plate holder, wherein when the plate holder is located at the second position, the new plate held by said plate holder is retreated from the old plate removal path, and wherein when the plate holder is located at the third position, the new plate held by said plate holder is inserted into said plate fixing unit.

9. A plate exchanging apparatus in a rotary printing press, comprising:

a plate fixing unit provided to a plate cylinder;

a plate holder for holding a new plate before inserting to said plate fixing unit;

actuator means for moving said plate holder to selectively position said plate holder at a first position apart from the plate cylinder, a third position close to the plate cylinder and a second position between the first and third positions; and a guide rail for guiding said plate holder such that said plate holder can move between the first, second, and third positions, wherein when the plate holder is located at the first position, the new plate is held by said plate holder, wherein when the plate holder is located at the second position, the new plate held by said plate holder is retreated from an old plate removal path, and wherein when the plate holder is located at the third position, the new plate held by said plate holder is inserted into said plate fixing unit.

10. The apparatus according to claim 9, wherein said guide rail comprises:

a first straight portion extending in a direction to insert the new plate held by said plate holder into said plate fixing unit;

a curved portion connected to a counter plate cylinder-side end of said first straight portion to change a traveling direction of said plate holder; and a second straight portion extending in substantially the vertical direction.

11. A plate exchanging apparatus in a rotary printing press, comprising:

a plate fixing unit provided to a plate cylinder;

a plate holder for holding a new plate before inserting to said plate fixing unit;

actuator means for moving said plate holder to selectively position said plate holder at a first position apart from the plate cylinder, a third position close to the plate cylinder and a second position between the first and third positions, and a plate catch member disposed in an old plate removal path below said plate holder and pivotally supported between an open position where an old plate removed from the plate cylinder is held and a closed position where said plate catch member is retreated from the old plate removal path, wherein when the plate holder is located at the first position, the new plate is held by said plate holder, wherein when the plate holder is located at the second position, the new plate held by said plate holder is retreated from the old plate removal path, wherein when the plate holder is located at the third position, the new plate held by said plate holder is inserted into said plate fixing unit, and wherein when said plate holder is located at the second position, a cylinder opposing side of the old plate removal path is covered with said plate catch member and a rear surface of the new plate held by said plate holder, thereby preventing the old plate removed from the plate cylinder from popping out from the old plate removal path.

* * * * *